US010339851B2

(12) United States Patent
Matsumoto

(10) Patent No.: US 10,339,851 B2
(45) Date of Patent: Jul. 2, 2019

(54) DISPLAY APPARATUS, LIGHTING CONTROL CIRCUIT, AND METHOD OF LIGHTING DISPLAY APPARATUS

(71) Applicant: NICHIA CORPORATION, Anan-shi (JP)

(72) Inventor: Makoto Matsumoto, Tokushima (JP)

(73) Assignee: NICHIA CORPORATION, Anan-shi (JP)

( * ) Notice: Subject to any disclaimer, the term of this patent is extended or adjusted under 35 U.S.C. 154(b) by 331 days.

(21) Appl. No.: 15/140,783

(22) Filed: Apr. 28, 2016

(65) Prior Publication Data

US 2016/0321980 A1 Nov. 3, 2016

(30) Foreign Application Priority Data

Apr. 30, 2015 (JP) ..... 2015-093661

(51) Int. Cl.
*G09G 3/32* (2016.01)
*G09G 3/20* (2006.01)
*G09G 3/3216* (2016.01)

(52) U.S. Cl.
CPC ..... *G09G 3/2025* (2013.01); *G09G 3/2044* (2013.01); *G09G 3/2077* (2013.01); (Continued)

(58) Field of Classification Search
CPC .. G09G 3/2025; G09G 3/3216; G09G 3/2044; G09G 3/2077; G09G 3/32; G09G 2300/06
See application file for complete search history.

(56) References Cited

U.S. PATENT DOCUMENTS 5,596,349 A 1/1997 Kobayashi et al.
8,094,172 B2 * 1/2012 Endo ..... G09G 3/2022 345/698
2002/0030672 A1 3/2002 Honda et al.
(Continued)

FOREIGN PATENT DOCUMENTS

JP 06-75544 3/1994
JP 06-118920 4/1994
(Continued)

OTHER PUBLICATIONS

Japanese Office Action for corresponding JP Application No. 2015-093661, dated Jun. 6, 2017 (w/ machine translation).

*Primary Examiner* — Nicholas J Lee
*Assistant Examiner* — Gerald L Oliver
(74) *Attorney, Agent, or Firm* — Mori & Ward, LLP

(57) ABSTRACT

A display apparatus includes a display, a voltage controller, a current driver, and a lighting control circuit. The control by the lighting control circuit is such that one frame is divided into N-pieces of subframes (the N is a natural number equal to or greater than two) which can be displayed at a predetermined frame rate f. In first frame cycle, one frame is divided into M-pieces of virtual subframes (the M is a natural number greater than the N), and N-pieces out of the M-pieces of the virtual subframes are selected as first displayed subframes and displayed on the display. Unselected (M–N) pieces of the virtual subframes are not displayed in the first frame cycle. In second frame cycle subsequent to the first frame cycle, the virtual subframes corresponding to undisplayed virtual subframes in the first frame cycle are selected as second displayed subframes.

22 Claims, 16 Drawing Sheets

(52) U.S. Cl.
CPC ..... *G09G 3/32* (2013.01); *G09G 3/3216* (2013.01); *G09G 2300/06* (2013.01)

(56) References Cited

U.S. PATENT DOCUMENTS

| | | | | |
|---|---|---|---|---|
| 2002/0130893 | A1* | 9/2002 | Okuda | G09G 3/2011 345/691 |
| 2003/0156102 | A1 | 8/2003 | Kimura | |
| 2003/0214245 | A1 | 11/2003 | Yamazaki et al. | |
| 2005/0184944 | A1* | 8/2005 | Miyata | G09G 3/3611 345/89 |
| 2006/0181490 | A1 | 8/2006 | Ozaki | |
| 2008/0180424 | A1* | 7/2008 | Ishihara | G09G 3/3611 345/204 |
| 2008/0198185 | A1* | 8/2008 | Maruyama | G09G 3/2025 345/698 |
| 2009/0284502 | A1* | 11/2009 | Hayafuji | G09G 3/2025 345/205 |
| 2010/0053223 | A1 | 3/2010 | Otsuka et al. | |
| 2010/0091042 | A1* | 4/2010 | Inoue | G09G 3/2025 345/690 |
| 2010/0188393 | A1* | 7/2010 | Seki | G09G 3/2025 345/213 |
| 2013/0162696 | A1* | 6/2013 | Matsumoto | G09G 3/32 345/690 |
| 2015/0279276 | A1* | 10/2015 | Xu | G09G 3/3258 345/77 |
| 2015/0287354 | A1* | 10/2015 | Wang | G09G 3/2051 345/598 |

FOREIGN PATENT DOCUMENTS

| | | | |
|---|---|---|---|
| JP | 2001-306020 | 11/2001 | |
| JP | 2004-126501 | 4/2004 | |
| JP | 2006-503327 | 1/2006 | |
| JP | 2006-189807 | 7/2006 | |
| JP | 2008-525837 | 7/2008 | |
| JP | 2008-250334 | 10/2008 | |
| JP | 2010-054989 | 3/2010 | |
| JP | 2011107246 A * | 6/2011 | G09G 5/36 |
| JP | 2013-134377 | 7/2013 | |
| WO | WO 2004/036536 | 4/2004 | |
| WO | WO 2006/067520 | 6/2006 | |

* cited by examiner

FIG. 4
| | 1st COLUMN | 2nd COLUMN | 3rd COLUMN |
|---|---|---|---|
| 1st ROW | LED1 | LED2 | LED3 |
| 2nd ROW | LED4 | LED5 | LED6 |
| 3rd ROW | LED7 | LED8 | LED9 |
FIG. 5A
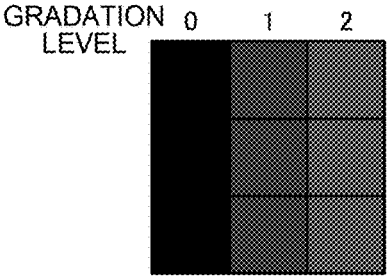
FIG. 5B
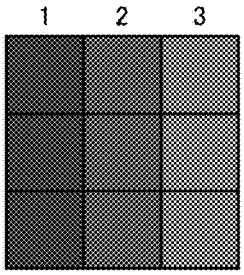
FIG. 5C
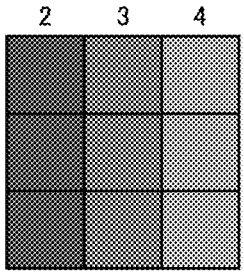
FIG. 5D
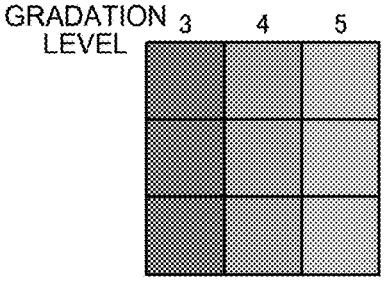
FIG. 5E
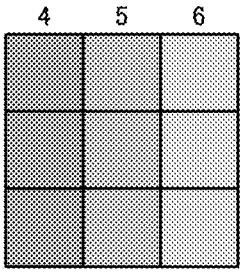
FIG. 5F
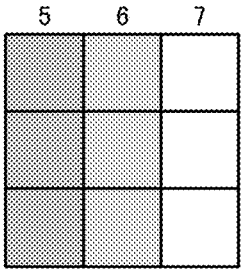
FIG. 5G
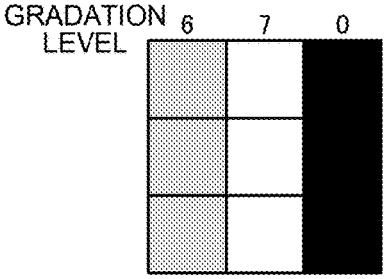
FIG. 5H
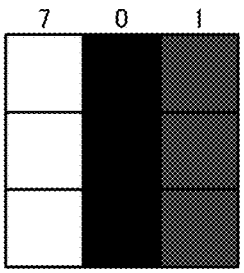

FIG. 7

| | VIRTUAL SUBFRAME | | | | | | |
|---|---|---|---|---|---|---|---|
| | 1 | 2 | 3 | 4 | 5 | 6 | 7 |
| GRADATION LEVEL 7 | ON | ON | ON | ON | ON | ON | ON |
| GRADATION LEVEL 6 | ON | ON | ON | OFF | ON | ON | ON |
| GRADATION LEVEL 5 | ON | OFF | ON | ON | ON | OFF | ON |
| GRADATION LEVEL 4 | ON | OFF | ON | OFF | ON | OFF | ON |
| GRADATION LEVEL 3 | OFF | ON | OFF | ON | OFF | ON | OFF |
| GRADATION LEVEL 2 | OFF | ON | OFF | OFF | OFF | ON | OFF |
| GRADATION LEVEL 1 | OFF | OFF | OFF | ON | OFF | OFF | OFF |
| GRADATION LEVEL 0 | OFF | OFF | OFF | OFF | OFF | OFF | OFF |

FIG. 9

| | VIRTUAL SUBFRAME | | | | | | | |
|---|---|---|---|---|---|---|---|---|
| | 1 | 2 | 3 | 4 | 5 | 6 | 7 | 8 |
| GRADATION LEVEL 8 | ON | ON | ON | ON | ON | ON | ON | ON |
| GRADATION LEVEL 7 | OFF | ON | ON | ON | ON | ON | ON | ON |
| GRADATION LEVEL 6 | OFF | ON | ON | ON | OFF | ON | ON | ON |
| GRADATION LEVEL 5 | OFF | ON | OFF | ON | ON | ON | OFF | ON |
| GRADATION LEVEL 4 | OFF | ON | OFF | ON | OFF | ON | OFF | ON |
| GRADATION LEVEL 3 | OFF | OFF | ON | OFF | ON | OFF | ON | OFF |
| GRADATION LEVEL 2 | OFF | OFF | ON | OFF | ON | OFF | ON | OFF |
| GRADATION LEVEL 1 | OFF | OFF | OFF | OFF | ON | OFF | OFF | OFF |
| GRADATION LEVEL 0 | OFF | OFF | OFF | OFF | OFF | OFF | OFF | OFF |

FIG. 12

| | | VIRTUAL SUBFRAME | | | | | | | |
|---|---|---|---|---|---|---|---|---|---|
| | | 1 | 2 | 3 | 4 | 5 | 6 | 7 | 8 |
| LOWER ORDER 3bit | 111 | 0 | +1 | +1 | +1 | +1 | +1 | +1 | +1 |
| | 110 | 0 | +1 | +1 | +1 | 0 | +1 | +1 | +1 |
| | 101 | 0 | +1 | 0 | +1 | +1 | +1 | 0 | +1 |
| | 100 | 0 | +1 | 0 | +1 | 0 | +1 | 0 | +1 |
| | 011 | 0 | 0 | +1 | 0 | +1 | 0 | +1 | 0 |
| | 010 | 0 | 0 | +1 | 0 | 0 | 0 | +1 | 0 |
| | 001 | 0 | 0 | 0 | 0 | +1 | 0 | 0 | 0 |
| | 000 | 0 | 0 | 0 | 0 | 0 | 0 | 0 | 0 |

DISPLAY APPARATUS, LIGHTING CONTROL CIRCUIT, AND METHOD OF LIGHTING DISPLAY APPARATUS

CROSS-REFERENCE TO RELATED APPLICATION

The present application claims priority under 35 U. S. C. § 119 to Japanese Patent Application No. 2015-093661, filed on Apr. 30, 2015, the content of which is incorporated by reference in its entirety.

BACKGROUND

1. Technical Field

The present disclosure relates to a display apparatus, a lighting control circuit, and a method of driving lighting of a display apparatus.

2. Description of Related Art

Nowadays, a display unit using light emitting diodes (LEDs) as light emitting elements and a display apparatus using the display unit are manufactured. For example, combining a plurality of display units allows for obtaining a large-size display apparatus. In a display unit including LEDs arranged in an m row by n column dot matrix array, for example, anode terminals of LEDs at each row are connected to a single common line, and cathode terminals of LEDs at each column are connected to a single drive line. Then, the m-rows of common lines are successively turned ON at a predetermined cycle, and the LEDs disposed on the turned-ON common lines are individually driven by the drive lines.

In order to display an image by such display unit, conventionally, a frame, which is a single unit for displaying one image, is divided into a plurality of subframes. In such dividing of a frame into subframes, while the same data (i.e., same brightness) is typically used in all subframes, brightness is varied in each subframe to display an image with multi-gradation (see JP 2010-054989 A). In this specification, displaying images with such multi-gradation using subframes is referred to as "subframe modulation".

In such subframe modulation, in order to increase the number of gradations, the subframes whose number corresponding to the number of gradations are required. However, the frame cycle, which is the cycle of updating image, is defined by each display unit, for example, to be 15 Hz, 30 Hz, 60 Hz or the like. Accordingly, in dividing one frame into a plurality of subframes, faster operation is required as the number of subframes increases. Therefore, in order to increase the number of gradations by subframe modulation, the hardware specification corresponding to the fast operations is required, resulting in a complicated structure and increased cost of the display apparatus. Accordingly, in a display unit to be driven at a small duty ratio of dynamic driving (e.g., 1/24 duty, 1/32 duty or the like) in relatively short subframe cycles, it is not easy to increase the number of gradations, i.e., the number of subframes.

SUMMARY

The present invention has been made in view of such background, and one object of the present invention is to provide a display apparatus, a lighting control circuit, and a method of driving lighting of a display apparatus, each of which enables multi-gradation display without increasing the number of subframes.

According to one aspect of the present invention, a display apparatus includes: a plurality of light emitting elements arranged in rows and columns to form a display, each of the plurality of light emitting elements having a first terminal and a second terminal, the first terminal being connected to one of a plurality of common lines arrange in rows and the second terminal being connected to one of a plurality of driving lines arrange in columns, a voltage controller connected to common lines to apply voltage thereto a current driver connected to the drive lines to flow current therethrough in accordance with timing at which the voltage controller applies voltage; and a lighting control circuit connected to the voltage controller and the current driver so as to control lighting of the light emitting elements based on a supplied display data including images to be displayed on the display, each image comprising a plurality of frames, each frame being divided into N-pieces of subframes. N is a natural number equal to or greater than two. A frame rate f is predetermined to perform display at a subframe cycle of $1/(f \times N)$. The lighting control circuit controls the voltage controller and the current driver by dividing one frame into M-pieces of the virtual subframes based on the display data (M is a natural number greater than N), and partially selecting N-pieces out of the M-pieces of the virtual subframes to be displayed in a first frame so that a displaying of the N-pieces out of M-pieces of the virtual subframes is performed in a first frame cycle which duration is 1/f at the predetermined frame rate f, [the N of the N-pieces of the virtual subframes being the same number with the N of the N-pieces of the displayed subframe], while the lighting control circuit discards (M–N) pieces of the virtual subframes as undisplayed subframes in the first frame. In second frame cycle subsequent to the first frame cycle, the lighting control circuit controls the voltage controller and the current driver by dividing one frame into M-pieces of the virtual subframes, and preferentially selecting the virtual subframes corresponding to the undisplayed subframes in the first frame out of the M-pieces of the virtual subframes as second displayed subframes, [the M of the M-pieces of the virtual subframes in the second frame being the same number with the M of M-pieces of the virtual subframes in the first frame].

With the structure described above, the number of subframes can be substantially increased between successive frames without increasing the actual frame rate, achieving higher definition display.

BRIEF DESCRIPTION OF THE DRAWINGS

FIG. 4 is a diagram illustrating an exemplary display of the display apparatus according to the first embodiment.

FIGS. 5A to 5H are diagrams illustrating exemplarily showing a series of exemplary displays of intermediate gradation images.

FIG. 7 is a table of subframe modulation according to the first embodiment.

FIG. 9 is a table of subframe modulation according to the second embodiment.

FIG. 12 is a table of subframe modulation according to the third embodiment.

DETAILED DESCRIPTION OF EMBODIMENTS

Figure 1:
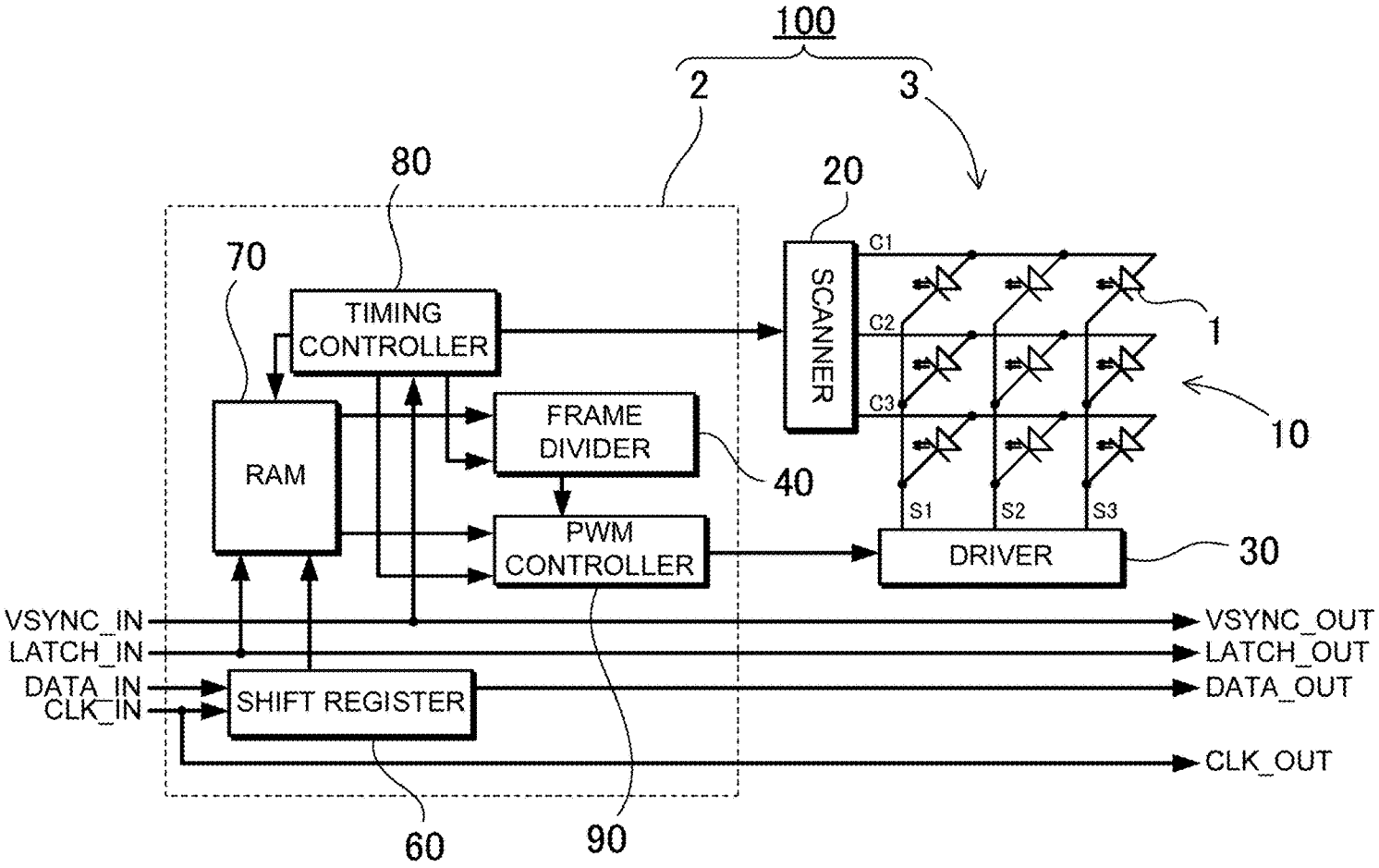
FIG. 1 is a block diagram illustrating a display apparatus according to a first embodiment.

In a display apparatus according to one embodiment of the present invention, the lighting control circuit is capable of dividing one frame into the M-pieces of the virtual subframes assigning gradation levels by gradation conversion on the virtual subframes so as to display an image of a frame having expected gradation levels with the M-pieces of the virtual subframes.

With the configuration described above, the number of virtual subframes M can be increased so as to be greater than the number of actual subframes N without increasing the actual frame rate. Therefore, it achieves the gradation conversion with increasing number of gradation levels greater than the number of that by real subframes, resulting in multi-gradation without hardware update.

Further, in a display apparatus according to another embodiment, the lighting control circuit can express M+1 gradation levels for each pixel with M-pieces of virtual subframes.

Still further, in a display apparatus according to another embodiment, the lighting control circuit performs the gradation conversion on the virtual subframes with reallocation of the virtual subframes in which the light emitting elements is ON such that ON virtual subframes are uniformly arranged in one frame.

With the configuration described above, due to the after-image effect of successive M-pieces of virtual subframes, flicker due to insertion of virtual subframes having undergone gradation conversion can be reduced, so that the gradations of an image can be seen to be apparently uniform. Further, the gradation difference between virtual subframes can be reduced.

Still further, in a display apparatus according to another embodiment, the lighting control circuit may perform pulse width modulation or weighting control in the M-pieces of virtual subframes which is element of one frame.

With the structure described above, more precise PWM and weighting control are enabled, using the virtual subframes greater in number than the actual frames.

Still further, in a display apparatus according to another embodiment, M may be a power of 2.

Still further, in a display apparatus according to other embodiment, the relationship between M and N can be $M \leq 2N$. With such a configuration, all the virtual subframes can be displayed within successive frames. Therefore, an image having undergone subframe modulation with less failure can be displayed.

Still further, in a display apparatus according to another embodiment, the lighting control circuit may provide individual identification information to each of the M-pieces of virtual subframes in one frame, and the identification information of a plurality of display subframes displayed in any one frame and the identification information of a plurality of display subframes displayed in other frame successive to the one frame may be at least partially different from each other.

Still further, in a display apparatus according to another embodiment, with the virtual subframes in which display is performed in any one frame and the virtual subframes in which display is performed in other frame successive to the one frame, so that the virtual subframes of every identification information may be displayed. With such a configuration, all the virtual subframes are displayed in two successive frames, so that the number of the subframes can be increased to realize gradated display or the like without accelerating the frame rate.

Still further, in a display apparatus according to another embodiment, the identification information may be information for identifying a virtual subframe in which lighting is to be performed for displaying multi-gradation by subframe modulation.

Still further, in a display apparatus according to another embodiment, the virtual subframe identification information may appear in numerical order in one frame, or in successive frames.

Still further, in a display apparatus according to another embodiment, a frame cycle during which a complete set of virtual subframe identification numbers appears may be 30 Hz or smaller, and a subframe cycle during which each of the display subframes is displayed may be 120 Hz or greater.

Still further, in a display apparatus according to another embodiment, the lighting control circuit may send gradation data of an image to the display.

Still further, in a display apparatus according to another embodiment, the lighting control circuit may send, in addition to the gradation data of an image, correction data for correcting brightness variations among brightness of the light emitting elements to the display.

Still further, in a display apparatus according to another embodiment, with the lighting control circuit, a display update cycle, which is a cycle of updating display, of one frame, can have a length that is different from a length of a display update cycle of another frame.

Still further, in a display apparatus according to another embodiment, the plurality of light emitting elements of the display may be arranged in a matrix.

Still further, with a display apparatus according to another embodiment, an image displayed on the display may be a still image or a moving image in which a displayed content scrolls.

Still further, according to another embodiment, a lighting control circuit is connected to a display apparatus including a display in which a plurality of light emitting elements are arranged, and sends display data to be displayed on the display. The lighting control circuit may divide one frame, which is one unit to display a complete image, into N-pieces (where N is a natural number equal to or greater than 2) of subframes to control the subframes to be displayed at a subframe cycle of $1/(f \times N)$ at a frame rate f, for each of the plurality of light emitting elements arranged at the display. Also, in the state where M-pieces (where M is a natural number greater than N) of virtual subframes are provided in one frame, the lighting control circuit may perform display of an image of the M-pieces of successive virtual subframes at the subframe cycle of 1/(f×N), so that an image of a frame is displayed on the display.

With this lighting control circuit, it becomes possible to increase the number of subframes without increasing the actual frame rate, achieving higher gradation display can be realized.

Still further, in a lighting control circuit according to another embodiment, with the M-pieces of successive virtual subframes, an image of one frame can be displayed exceeding a display cycle of the one frame defined by the frame rate f.

Still further, in a lighting control circuit according to another embodiment, when one frame is divided into the M-pieces of virtual subframes, virtual subframes having gradation levels that is different from the gradation levels of the one frame may be generated, and gradation conversion may be performed with the virtual subframes so that a frame having desired gradation levels is displayed when the M-pieces of virtual subframes are added up. With this configuration, the number of the virtual subframes can be increased than the number of the real subframes without increasing the frame rate of real subframe, so that gradation conversion of the one frame in which the number of gradation levels can be expressed than the number of the gradation levels that can be expressed by the real subframes can be realized. Thus, multi-gradation can be achieved without changing the specification of hardware of the display apparatus.

Still further, with a method of lighting a display apparatus according to another embodiment, the display apparatus may include:

a display in which a plurality of light emitting elements are arranged in rows and columns;

a scanner connected to a plurality of common lines which are connected to one terminals of the plurality of light emitting elements arranged in a row direction of the display, the scanner being capable of scanning the common lines; a current driver connected to a plurality of drive lines which are connected to other terminals of the plurality of light emitting elements arranged in a column direction of the display, the current driver being capable of lighting predetermined light emitting elements in accordance with scanning timing of the scanner; and a lighting control circuit to control the scanner and the current driver so as to control lighting of the light emitting elements based on provided display data. In this method of lighting the display apparatus, one frame, which is a single unit for displaying one image, is divided into N-pieces (in which N is a natural number equal to or greater than 2) of subframes, display of the subframes is performed at a subframe cycle of 1/(f×N) at a predetermined frame rate f, and the method may include: operating the lighting control circuit to acquire the display data which is to be displayed on the display; and operating the lighting control circuit to divide one frame into M-pieces (in which M is a natural number greater than N) of virtual subframes for each of the plurality of light emitting elements based on the display data and display the M-pieces of successive virtual subframes at the subframe cycle of 1/(f×N) at the predetermined frame rate f to an image of the one frame on the display. With this configuration, the number of the subframes can be increased without increasing the actual frame rate, achieving higher gradation display.

Still further, in a method of lighting a display apparatus according to another embodiment, display of the M-pieces of successive virtual subframes is performed exceeding a frame period, which is time for displaying an image of the one frame defined by the frame rate f, to display an image of one frame.

Still further, in a method of lighting a display apparatus according to another embodiment, when the one frame is divided into the M-pieces of virtual subframes, the number of gradation levels of virtual subframes is different from the number of the gradation levels of the one frame may be generated, and gradation conversion may be performed with the virtual subframes so that an image of a frame having desired gradation levels is displayed when the M-pieces of virtual subframes are added up. With this configuration, the number of the virtual subframes can be increased than the number of the real subframes without increasing the actual frame rate, so that gradation conversion of the one frame in which the number of gradation levels can be expressed than the number of the gradation levels that can be expressed by the real subframes can be realized. Thus, multi-gradation can be achieved without changing the specification of hardware of the display apparatus.

Still further, in a method of lighting a display apparatus according to another embodiment, when the gradation conversion with the virtual subframes is performed, a display order of virtual subframes may be set such that the virtual subframes of different gradation levels are dispersed in the M-pieces of virtual subframes. With this configuration, due to the afterimage effect of the successive M-pieces of virtual subframes, flicker attributed to insertion of virtual subframes having undergone gradation conversion is reduced, so that the gradations of an image can be apparently uniform.

Still further, in a method of lighting a display apparatus according to another embodiment, pulse width modulation or weighting control may be performed on the M-pieces of virtual subframes in one frame. This configuration allows for more precise PWM or weighting control using the virtual subframes which is greater than in number than the number of the real frames.

Still further, with a method of lighting a display apparatus according to another embodiment, M may be a number of a power of 2.

Display Apparatus

FIG. 1 is a circuit diagram of a display apparatus according to a first embodiment of the present invention. A display apparatus 100 shown in FIG. 1 includes a display unit 3 and a lighting control circuit 2. The display unit 3 includes a display 10 in which a plurality of light emitting elements 1 are arranged, a scanner 20 (corresponding to claimed voltage controller) and a driver 30 (corresponding to claimed current driver), which is for driving the light emitting elements 1 that structures the display 10. The lighting control circuit 2 serves to control the scanner 20 and the driver 30 so as to light the light emitting elements 1 at predetermined timing, for example, as shown in the timing chart of FIG. 2.

The scanner 20 is connected to a plurality of common lines C, which are connected to anode terminals of the plurality of light emitting elements 1 arranged in the row direction in the display 10. The scanner 20 scans the common lines C, and applies voltage to any selected common line C. On the other hand, the driver 30 is connected to a plurality of drive lines S, which are connected to cathode terminals of the plurality of light emitting elements 1 arranged in the column direction in the display 10. The driver 30 is configured to light predetermined light emitting elements 1 according to the timing at which the scanner 20 performs scanning. Further, the display 10 includes a power supply circuit for driving the light emitting elements 1.

Further, the lighting control circuit 2 is configured to control the scanner 20 and the driver 30 so as to control lighting of the light emitting elements 1.

In the present embodiment, a description will be given of an exemplary case where the display apparatus 100 is an LED driving device in which LEDs are used for the light emitting elements 1.

Light Emitting Elements 1

For the light emitting elements 1 of the display 10, a semiconductor light emitting elements can be used, and for example, light emitting diodes, semiconductor lasers or the like can be preferably employed. Further, the display 10 includes a plurality of light emitting elements arranged in a matrix. Note that, in the present specification, the definition of the term "in a matrix" includes the case where the light emitting elements are arranged in a grid of m-rows by n-columns, the case where the light emitting element are arranged so as to be staggered in adjacent rows, and the case where the light emitting element are arranged rhombically or diagonally. Further, as well as LEDs, a liquid crystal panel or an organic EL element may also be used for the light emitting elements of the display 10. In the exemplary configuration shown in FIG. 1, the display 10 includes nine LEDs, which are arranged in three (longitudinal)×three (lateral), as the light emitting elements 1. Here, the nine LEDs are referred to as LEDs 1 to 9, from the uppermost row to the lowermost row.

Further, the light emitting elements 1 of the display 10 each include a pair of positive and negative terminal portions for being supplied with electricity to drive. One of the pair of terminals is connected to one of the common lines, and the other terminal is connected to one of the drive lines. In the exemplary structure shown in FIG. 1, the LEDs each include an anode terminal and a cathode terminal as the pair of terminals. The anode terminal is connected to one of the common lines, and the cathode terminal is connected to one of the drive lines.

Figure 3:
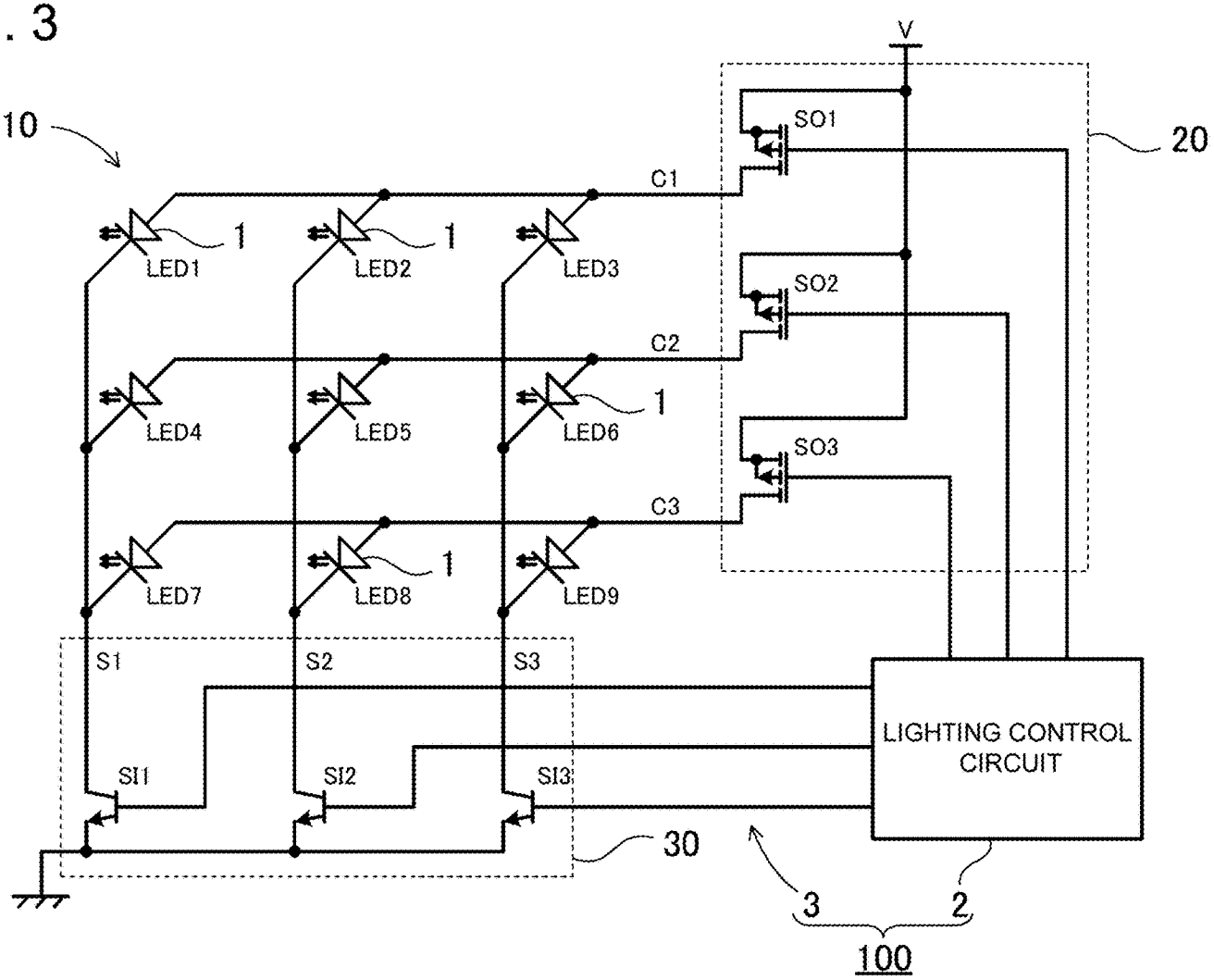
FIG. 3 is a circuit diagram illustrating a scanner and a current driver of the display apparatus according to the first embodiment.

FIG. 3 is a circuit diagram exemplarily illustrating the scanner 20 and the driver 30. In this exemplary structure, the scanner 20 includes source-side switches SO1 to SO3 as the source drivers respectively connected to one ends of the common lines C1 to C3. For the source-side switches SO1 to SO3, semiconductor switching elements such as FETs are used, for example.

Further, on a drive line side, a power supply circuit is connected. In the exemplary structure shown in FIG. 3, as the power supply circuit, a voltage source V for supplying voltage to the LEDs 1 to 9 is connected via the source-side switches SO1 to SO3 to one ends of the common lines C1 to C3. Specifically, a drain side of FET of each switch is connected to the voltage source V; the source side of that is connected to each of one ends of the common lines C1 to C3 (the anode side of the LEDs is connected); and the gate side of that is connected to the lighting control circuit 2.

On the other hand, to the driver 30, sink-side switches SI1 to SI3 of sink drivers connected to the drive lines are connected. For the sink-side switches SI1 to SI3, for example, bipolar transistors may be used.

In the exemplary structure shown in FIG. 1, LEDs are arranged in three rows by three columns, which allows for arranging three common lines C1 to C3 and three drive lines S1 to S3. More specifically, in view of the common lines in a row direction, the common line C1 is connected to the anode terminals of the LEDs 1 to 3; the common line C2 is connected to the anode terminals of the LEDs 4 to 6; and the common line C3 is connected to the anode terminals of the LEDs 7 to 9. Further, in view of the drive lines in a column direction, the drive line S1 is connected to the cathode terminals of the LEDs 1, 4, and 7; the drive line S2 is connected to the cathode terminals of the LEDs 2, 5, and 8; and the drive line S3 is connected to the cathode terminals of the LEDs 3, 6, and 9.

Display 10

The display 10 includes a plurality of light emitting elements 1 arranged in rows and columns, a plurality of common lines C1 to C3 connected to the anode terminals of the plurality of light emitting elements 1 in the row direction, and a plurality of drive lines S1 to S3 connected to the cathode terminals of the plurality of light emitting elements 1 in the column direction.

FIG. 4 is a schematic diagram showing an exemplary arrangement of the light emitting elements of the display 10. As shown in FIG. 4, the display 10 of the display apparatus 100 is made of nine sections arranged in three rows by three columns matrix. A plurality of LEDs 1 to 9 are respectively arranged to the nine sections. For example, during a lighting period of the LED 1, the section to which the LED 1 is arranged (for example, the section at first row and first column) is lit, and during a lighting period of LED 9, the section to which the LED 9 is arranged (for example, the section at third row and third column) is lit.

Lighting Control Circuit 2

The lighting control circuit 2 controls the scanner 20, which is connected to the common lines C and serve to scan the common lines C in each frame and to apply voltage to the common lines C, and the driver 30, which is connected to the drive lines S and capable of driving the light emitting elements 1 on a frame-by-frame basis based on control data that is externally input. The lighting control circuit 2 includes a frame divider 40 which serve to divide one frame, which is for displaying one image, into a plurality of subframes.

Figure 2:
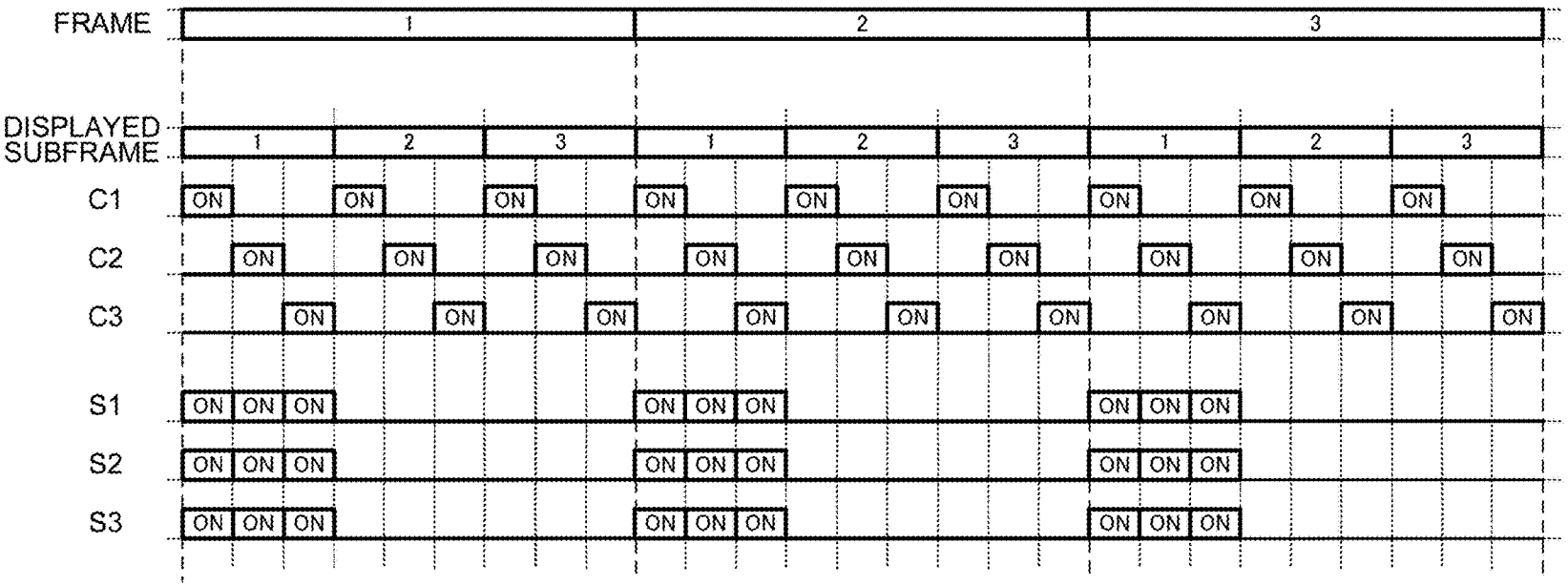
FIG. 2 is a timing chart illustrating an exemplary lighting of a display apparatus shown in FIG. 1.

The lighting control circuit 2 serve to control the lighting pattern of the light emitting elements 1 to display a still image, characters, figures or a scrolling image in which these display contents move horizontally or vertically on the display 10. FIG. 2 is an exemplary timing chart showing the timing at which the lighting control circuit 2 lights the light emitting elements 1.

Common Lines C1 to C3

The common lines C1 to C3 are connected to one ends of a plurality of LEDs 1 to 9, respectively. In the exemplary structure shown in FIG. 3, anode-common connection is established in which the anode sides the plurality of LEDs 1 to 9 is connected to the common lines C1 to C3. The present invention is not limited to this structure, and for example, cathode-common connection can be employed in which cathode sides of the LEDs are connected to the common lines C1 to C3. Note that, the common lines supply voltage in the case of the anode-common connection, and the drive lines supply voltage in the case of the cathode-common connection.

For the common lines C1 to C3, copper foil or the like (for example, a portion of a wiring of a printed circuit board) is used. On a printed circuit board or the like, the common lines C1 to C3 can have various shapes such as linear, planar (for example, quadrangular, circular) or the like. Note that, in the present specification, the term "line" is not intended to limit the actual shape of the common lines C1 to C3 arranged on a printed circuit board or the like to be a linear shape, but is used because the common lines C1 to C3 can be represented as lines when the common lines C1 to C3 are schematically illustrated in the circuit diagram. Each of the common lines C1 to C3 may be branched midway. Note that, though three common lines are provided in the present embodiment, the number of the common lines is may be at least one.

Voltage Source V

The voltage source V supplies voltage to a plurality of LEDs 1 to 9. In the case where the number of the common lines is two or more, the voltage source V may be provided for each of the common lines C1 to C3, or may be shared by the two or more common lines C1 to C3 as shown in FIG. 3. In the case where the voltage source V is shared by two or more common lines C1 to C3, the voltage from the voltage source V may be constantly applied to the common lines C1 to C3 (i.e. the static control scheme), or may be applied time-divisionally (i.e. the dynamic control scheme). For the voltage source V, a stabilized direct current voltage source of series mode or switched mode, for example, can be used Source-Side Switches SO1 to SO3

The source-side switches SO1 to SO3 are switches for connecting the common lines C1 to C3 and the voltage source V, and are time-divisionally turned ON or OFF by the lighting control circuit 2. For the source-side switches SO1 to SO3, P-channel type FETs (Field Effect Transistors) or PNP transistors may be used.

Plurality of Drive Lines S1 to S3

A plurality of drive lines S1 to S3 are connected to other ends of a plurality of LEDs 1 to 9, respectively. For the drive lines S1 to S3, copper foil or the like may be used (for example, a portion of a wiring of a printed circuit board).

Sink-Side Switches SI1 to SI3

The sink-side switches SI1 to SI3 are connected to a plurality of drive lines S1 to S3, respectively, to connect the drive lines S1 to S3 and GND. The sink-side switches SI1 to SI3 are turned ON or OFF by the lighting control circuit 2. For the sink-side switches SI1 to SI3, NPN transistors, N-channel type field-effect transistors (FETs), or the like may be used. Further, though not shown in the drawing, the current flowing through the drive lines can be controlled by a resistor or a constant current source, which are arranged between the sink-side switches SI1 to SI3 and GND or between the sink-side switches SI1 to SI3 and the drive lines.

Lighting Control Circuit 2

Lighting Control Circuit 2 controls a plurality of LEDs 1 to 9 by turning ON or OFF the source-side switches SO1 to SO3 and the sink-side switches SI1 to SI3. For example, in the case of lighting the LED 5, turning ON the source-side switch SO2 and the sink-side switch SI2 makes current flow in the path of: voltage source V→common line C2→LED 5→drive line S2→GND in this order, so that the LED 5 is lit. Selection of LED to be lit is performed using the subframe modulation.

Note that, for the lighting control circuit 2, a field programmable gate array (FPGA), a microcomputer, or a combination of these can be used.

Shift Register 60

The shift register 60 externally receives and inputs a signal CLK_IN of display data DATA_IN, which represents one image, with shift clock. The shift register 60 can retain display data corresponding to subframe modulation and PWM gradation for all the light emitting elements 1 of the display 10.

RAM 70

The RAM 70 stores the data of the shift register 60 by LATCH_IN. Though not described in the pictures, in order to control display of the image on the display 10, the RAM 70 is made of two or more RAMs independent of each other for reading from the frame divider 40 and the PWM controller 90 and for receiving display data from the outside, that is, for writing the data of shift register 60.

Timing Controller 80

A timing controller 80 generates frames by VSYNC_IN, and controls timing of each controller.

PWM Controller 90

The PWM controller 90 performs PWM gradation control based on display data read from the RAM 70 in subframes generated by the frame divider 40.

Frame

In the description below, explanation of the terms will be given. In the present specification, a frame is defined to be a unit for displaying one image on the display screen of the display apparatus, and is made of a plurality of subframes in order to display a predetermined gradation.

Subframe

The subframes are obtained by one or more divisions of a frame.

Subframe Identification Number

Further, to each virtual subframe, individual identification information is provided. In the present embodiment, the lighting control circuit 2 provides a subframe identification number to each virtual subframe as the identification information. The subframe identification numbers are used in subframe modulation for identifying the virtual subframes which form one frame, or for identifying a virtual subframe from which lighting is to be started. Hence, the order of lighting and the order of appearance (i.e. arrangement) of LEDs may not necessarily agree with the order of the virtual subframe identification numbers. Note that, in the present specification, for the sake of simplicity, the virtual subframes respectively given the subframe identification numbers of 1, 2, 3, . . . are simply referred to as virtual subframe 1, virtual subframe 2, virtual subframe 3, . . . and the like.

Display Update Cycle

The display update cycle is the cycle of updating display of an image, and represents the limit of a frame, which is one unit for displaying an image. The number of subframes of one frame depends on the length of the display update cycle.

Subframe Cycle

The subframe cycle is the time interval of the subframes, and the time interval is constant among the frames.

Series of Lighting Pattern

The display apparatus 100 displays a series of lighting patterns on the display 10 by lighting or unlighting a plurality of LEDs 1 to 9. Here, as an exemplary image displayed on the display 10 shown in FIG. 4, an example of a series of exemplary displays in which the display pattern is changed as time passes is shown in the schematic diagrams of FIG. 5A to FIG. 5H. For example, in the case where the images FIG. 5A to FIG. 5H are displayed in the order of FIG. 5A→FIG. 5B→FIG. 5C→FIG. 5D→FIG. 5E→FIG. 5F→FIG. 5G→FIG. 5H from frame 1, a left-scroll display in which a light/dark pattern shifts from right to left is obtained. Further, after displaying FIG. 5H, the left-scroll display may be continued by, for example, repeatedly displaying FIG. 5A→FIG. 5B→ . . . . Alternatively, in the case where a single image is continuously displayed such as FIG. 5D→FIG. 5D→FIG. 5D→ . . . →FIG. 5D→FIG. 5D, still image display is obtained.

Multi-Gradation Displaying Method

In the description below, displaying the pixels of the display 10 with multi-gradation using such a display apparatus 100 will be illustrated. For example, in order to display eight gradation levels of gradations 0 to 7, the light emission amount of the LEDs for each pixel may be controlled by eight levels. For example, there is known a multi-gradation displaying method in which one frame is divided into a plurality of subframes, the lighting pattern of the subframes which are time-divisionally displayed are varied, and the plurality of images displayed on the subframes are composed to obtain afterimage effect, which allows to represent multi-gradation display. Such a method of displaying multi-gradation of an image using subframes is referred to as "subframe modulation" in the present specification. For example, one frame is divided into eight subframes, and one pixel is turned ON in one of the eight subframes and turned OFF in the rest seven subframes. In the case where these subframes are successively displayed, in the obtained frame, the brightness of one pixel can be relatively reduced to ⅛. In this multi-gradation displaying method, the LEDs can be controlled using the lighting time thereof, so that the wavelength of light emitted from the LEDs may not be changed, and the advantage of high linearity of brightness can be obtained.

On the other hand, in order to increase the number of gradations to be displayed with multi-gradation, the number of subframes must be increased. That is, while one frame must be divided into a plurality of subframes, as the number of subframes increases, the time of displaying each subframe is reduced, i.e., a fast screen switching operation is required, which may result in an increase in both the frame rate and the burden on hardware. For example, in order to display eight gradations of gradations 0 to 7, the frame rate must be accelerated by seven times. Thus, the level of the required specification of hardware may become high, and complication in the lighting control circuit or an increase in costs may be invited.

Accordingly, in one embodiment of the present invention, without accelerating the display update speed of subframes which is obtained by division of one frame, in other words, while maintaining the number of physical real subframes (N pieces), M-pieces of virtual subframes, whose number is greater than the number of the physical real subframes, are set. Then, using the virtual subframes, multi-gradation of an image is displayed. In this display with multi-gradation, out of the M-pieces of virtual subframes, N-pieces of virtual subframes, which are capable of being physically displayed in the frame cycle (1/f) [s] of one frame displayed at frame rate f, are selected as displayed subframes and displayed. On the other hand, the undisplayed (M−N) pieces of virtual subframes are discarded as undisplayed subframes so as not to be used for displaying the one frame. Further, in the frame cycle of the subsequent other frame, displayed subframes are selected from virtual subframes so as to include subframes which corresponds to the discarded undisplayed subframes of the previous frame. In this manner, all the virtual subframes are reproduced when the successive frames are observed through, so that, due to afterimage effect, displayed subframes are recognized as an image apparently made of M-pieces of subframes having undergone subframe modulation.

First Embodiment

In the description below, with reference to the timing charts of FIGS. 6A and 6B and the subframe modulation table in FIG. 7, exemplary subframe modulation according to the first embodiment is illustrated. In the first embodiment, an exemplary case in which a still image shown in FIG. 5D is displayed on a screen using the LEDs 1 to 9 shown in FIGS. 3 and 4 is illustrated.

Figure 6A:
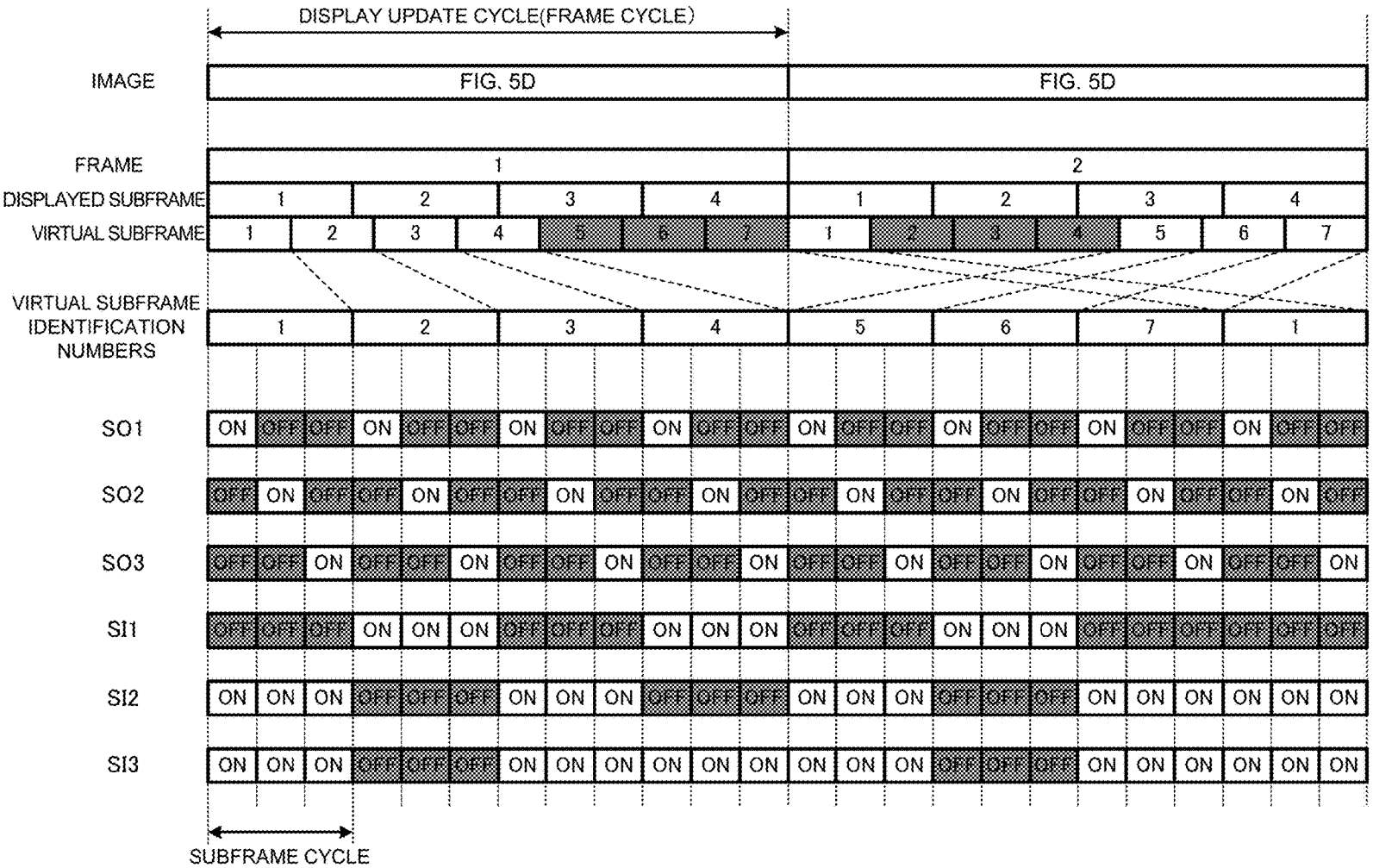
FIG. 6A is a timing chart of a lighting of a display apparatus with subframe modulation according to the first embodiment.
Figure 6B:
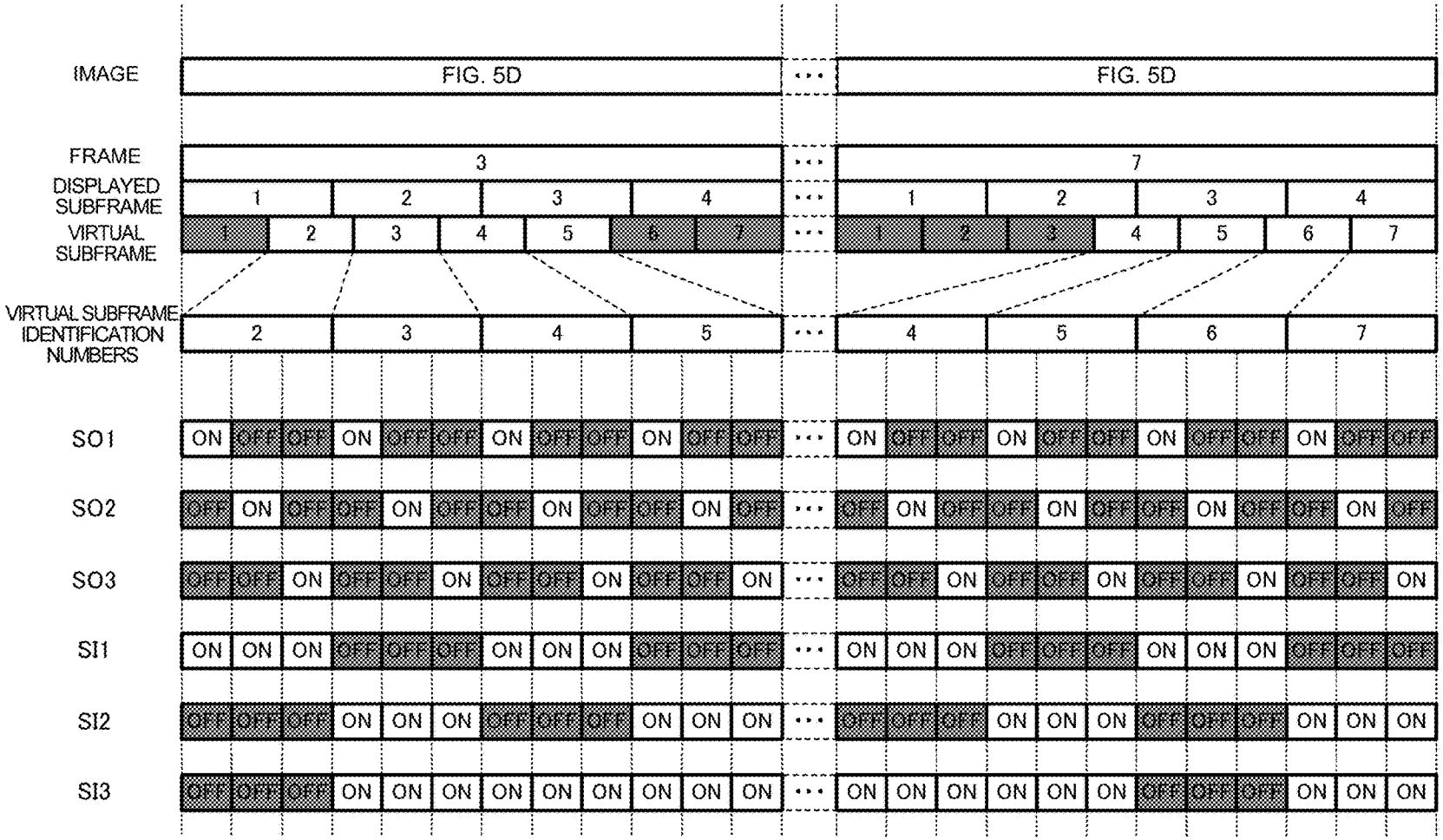
FIG. 6B is a timing chart continued from FIG. 6A.

FIGS. 6A and 6B are the timing charts of the display apparatus 100 according to the first embodiment. In these figures, for each display update cycle, the same display screen is updated from frame 1 in the order of FIG. 5D→FIG. 5D→FIG. 5D→ . . . →FIG. 5D, to display a still image. Further, seven virtual subframes are generated for one frame so that eight gradations of gradations 0 to 7 per pixel can be expressed.

Further, out of the seven virtual subframes of each frame that corresponds to one image, four virtual subframes are selected as the display subframes, and only the selected display subframes are displayed in the period of frame 1. In frame 1 shown in FIG. 6A, one image (one frame) that is illustrated as FIG. 5D is divided into seven virtual subframes, and subframe modulation is performed such that the image of FIG. 5D is obtained by synthesizing or successively displaying the seven virtual subframes. Thus, from one frame of FIG. 5D, seven virtual subframes are generated.

Identification Information

To each of the seven virtual subframes obtained in this manner, individual identification information is provided. For example, the lighting control circuit 2 provides virtual subframe identification numbers to M-pieces of virtual subframes in one frame.

In the exemplary case of FIG. 6A, virtual subframe identification numbers of 1 to 7 are allocated to each of seven virtual subframes. Out of the seven virtual subframes, four virtual subframes 1, 2, 3, and 4 are selected as the displayed subframes, which are displayed in frame 1, and are displayed on the display 10. In other words, three virtual subframes 5, 6, and 7 are discarded as the undisplayed subframes, which are not displayed in frame 1. In FIG. 6A, undisplayed subframes are shown in gray.

In the subsequent frame 2, from the frame of FIG. 5D, seven virtual subframes 1 to 7 are similarly generated. In this exemplary case, the same image is displayed in frame 1 and frame 2 (i.e., a still image is displayed), the virtual subframes of the frame 2 also have the same content as in the frame 1. However, in selecting the display subframes displayed in frame 2, virtual subframes 5, 6, and 7 of frame 2 corresponding to virtual subframes 5, 6, and 7 of frame 1, which serve as the undisplayed subframes in frame 1, are preferentially selected. Further, since four display subframes can be selected in frame 2, further one subframe can be selected. Here, returning to the top of the virtual subframes, virtual subframe 1 is selected. As a result, in frame 2, four virtual subframes 5, 6, 7, and 1 are displayed on the display 10 as the display subframes.

In this manner, through frames 1 and 2, a complete set of virtual subframe identification numbers appears. In other words, in two successive frames, all the virtual subframes can be displayed. In particular, in a still image, the virtual subframes generated from each of the frames have the same display content, so that the virtual subframes which are not displayed and discarded in one frame can be complemented by being displayed in the next frame. Thus, due to afterimage effect, apparently, the image can be seen by a user, who is the observer, as an image with multi-gradation.

Further, as described above, the order of selecting the virtual subframes is preferably in numerical order of the virtual subframe identification numbers. That is, in the subsequent frame 3, as shown in FIG. 6B, out of the virtual subframes 1 to 7, virtual subframes 2 to 4 of frame 3 are selected in correspondence with virtual subframes 2, 3, and 4 of frame 2, which serve as the undisplayed subframes in frame 2, and virtual subframe 5 is selected as the rest one.

As a result, in frame 3, the four displayed subframes are virtual subframes 2 to 5. Also, in the subsequent frame 4, not shown in the drawings, four virtual subframes 6, 7, 1, and 2 are selected as the displayed subframes so as to correspond with the undisplayed subframes in frame 3. By repeating such operations, undisplayed subframes, which are not displayed in one frame, can be displayed in the subsequent frame. Synthesizing of these frames can realize display of an image with multi-gradation.

Note that, the number of virtual subframes M is preferably twice as great as the number of real subframes N actually displayed in one frame or smaller, i.e., $M \leq 2N$. With this arrangement, since all the virtual subframes can be displayed in two frames, flicker or the like can be reduced, and apparently, recognition of the multi-gradation image can be facilitated.

Note that, in the exemplary case described above, after M-pieces of virtual subframes are generated by the lighting control circuit 2, undisplayed subframes are discarded. However, in subframe modulation, previously solely the display subframes may be generated. In other words, the discarded undisplayed subframes may not be necessarily generated. For example, a memory to retain the generated undisplayed subframes can be unnecessary.

Further, in the exemplary case described above, generation of virtual subframes and provision of obtained identification information are performed by the lighting control circuit 2, which is provided separately from the display 10. However, in the present invention, members that perform these operations are not limited to the lighting control circuit, and these operations can be performed by other members. For example, separately from the lighting control circuit, a circuit for generating virtual subframe or a circuit for providing identification information may be provided. Alternatively, such a virtual subframe generation function or an identification information application function can be imparted to the display or a display unit side. As described above, members to perform each processes are not particularly limited, and the processes can be executed using existing hardware and software such as a dedicated IC, a general-purpose computer or the like.

Subframe Modulation

Next, with reference to the subframe modulation table shown in FIG. 7, details of subframe modulation will be described. As shown in FIGS. 3 and 4, LED is a light emitting element and serves one pixel of the display. Each LED is turned ON and OFF only, i.e., there are two levels of 1 and 0 and no halftone. Followings are detailed description of one exemplary method of expressing halftone (eight gradation levels of 0 to 7) with subframe modulation. For example, in the description below, a case of realizing display of FIG. 5D is illustrated. In the example illustrated in FIG. 5D, the LEDs 1, 4, and 7 (shown in FIGS. 3 and 4) represent the lighting pattern of gradation level 3, the LEDs 2, 5, and 8 represent lighting pattern of gradation level 4, and the LEDs 3, 6, and 9 represent lighting pattern of gradation level 5. In the case where seven virtual subframes are generated to obtain the image of FIG. 5D, in order to realize pixels of gradation level 3, the corresponding pixels should be turned ON in three virtual subframes and turned OFF in four virtual subframes out of seven virtual subframes. Similarly, in order to realize gradation level 4, the corresponding pixels should be turned ON in four virtual subframes and OFF in three virtual subframes. In order to realize gradation level 5, the corresponding pixels should be turned ON for five virtual subframes and OFF for two virtual subframes.

In this case, among seven virtual subframes 1 to 7, the virtual subframes in which corresponding pixels are to be turned ON or OFF must be selected. In particular, in the case of gradation level 0, which has smallest brightness, the corresponding pixels should be turned OFF in all the virtual subframes, and in the case of gradation level 7, which has the greatest brightness, the corresponding pixels should be turned ON in all the virtual subframes. On the other hand, in the case of neutral gradation levels, the allocation of virtual subframes to be turned ON or OFF may be issue. Exemplary allocation is shown in a subframe modulation table illustrated in FIG. 7. The table in FIG. 7 shows the virtual subframes that are to be turned ON or OFF among the virtual subframes with virtual subframe identification numbers 1 to 7 for realizing gradation levels 0 to 7.

For example, in FIG. 7, in the case of gradation level 3, the corresponding pixels are turned ON in three virtual subframes 2, 4, and 6, and turned OFF in four virtual subframes 1, 3, 5, and 7 out of seven virtual subframes 1 to 7. Further, in the case of gradation level 4, the corresponding pixels are turned ON in four virtual subframes 1, 3, 5, and 7, and turned OFF in three virtual subframes 2, 4, and 6. Further, in the case of gradation level 5, the corresponding pixels are turned ON in five virtual subframes 1, 3, 4, 5, and 7, and turned OFF in two virtual subframes 2 and 6.

In this manner, turning ON/OFF of the corresponding pixels in virtual subframes is dispersedly arranged so as not to be continuous among successive virtual subframes, so that variations in brightness among virtual subframes can be reduced, and thus an observer can recognize a high-quality image with reduced flicker on the display apparatus. That is, for example, for display of gradation level 3 in FIG. 7, if pixels are turned ON in virtual subframes 1 to 3 and turned OFF in virtual subframes 4 to 7, successive arrangement of these virtual subframes over two displayed subframes allows the state where particular pixels are ON or OFF to be continued, and may be easily recognized as flicker. In view of this, dispersing ON periods and OFF periods allows such flicker to be reduced, and a high-quality image with uniform brightness can be obtained. That is, when the gradation conversion of virtual subframes is performed by the lighting control circuit, determining display order of M-pieces of virtual subframes so that the virtual subframes in which the light emitting elements are lit are evenly arranged in one frame can reduce flicker and allow the gradation of the image to recognized to be apparently uniform. Further, difference of the gradations among the virtual subframes can be reduced. Still further, such allocation of ON/OFF of the virtual subframes is preferably set such that the gradation difference of the virtual subframes is constant or small as much as possible. In particular, while the LEDs for the pixels are represented by just two values of ON/OFF in the exemplary case of FIG. 7, in the case where the brightness of the LEDs have multi-gradation of the brightness of the LEDs is generated by PWM control or the like, adjusting the order of displaying the virtual subframes so as to reduce the differences among the gradations of the virtual subframes can realize subframe modulation that can obtain a higher-quality gradated image.

Method of Driving Light Emitting Elements

Frame Cycle, Subframe Cycle

With reference to the circuit diagram of FIG. 3, a method of driving light emitting elements for displaying an image of displayed subframes on the display in order to realize multi-gradation display is described below. In the present embodiment, one subframe cycle is defined to be a unit of time for scanning the whole common lines. Further, in one frame cycle, four virtual subframes out of seven virtual subframes are selected as the display subframes, which allows for displaying an image on the display. The subframe cycle in which an image of the displayed subframes is displayed can be represented by 1/(f×N) [s] assuming the frame rate to be f, that is, assuming frame period to be 1/f [s], and assuming the number of real subframes is to be N pieces.

When the image of the displayed subframes is displayed, that is, in a subframe cycle, the source-side switches SO1 to SO3 are time-divisionally turned ON in this order, and the voltage is supplied to the common lines C1 to C3 from the voltage source V. In the description below, the operations for displaying images in FIG. 5D as described above, that is, the operations for displaying the image of intermediate gradation of gradation levels 3, 4, and 5 is illustrated. In the timing chart of FIG. 6A, the operations are described in order from display subframe 1 of frame 1. In frame 1, virtual subframes 1 to 4 are selected out of seven virtual subframes 1 to 7 as four displayed subframes 1 to 4. On the other hand, virtual subframes 5 to 7 serve as undisplayed subframes, and are not displayed. Note that, the pattern of the subframe modulation for multi-gradation display is as shown in the subframe modulation table of FIG. 7. For example, the lighting pattern of pixels in display subframe 1 for realizing each of gradation levels 3, 4, and 5 shown in FIG. 5D is, as described above, according to FIG. 7, such that the pixel is turned OFF for realizing gradation level 3, and the pixel is turned ON for realizing gradation levels 4 or 5.

Operation of Displayed Subframe 1 of Frame 1

First, in displayed subframe 1 of frame 1, an image of the virtual subframe with virtual subframe identification number 1 is displayed. During this period, that is, during the period of the subframe cycle of display subframe 1 shown in the timing chart in FIG. 6A, the source-side switches SO1, SO2, and SO3 are successively switched. Further, as to the sink-side switches in this period, SI1 is maintained to be OFF, and S12 and SI3 are maintained to be ON. First, in the period in which the source-side switch SO1 is ON, as shown in the circuit diagram in FIG. 3, the LEDs 1 to 3 connected to the common line C1 are the lighting control targets. On the other hand, in this period, as shown in the timing chart of FIG. 6A, the sink-side switch SI1 is OFF and SI2 and SI3 are ON. With this case, the LED 1 is not lit, and the LEDs 2 and 3 are lit. Next, in the period in which the source-side switch SO2 is ON, the sink-side switch SI1 is OFF, and SI2 and SI3 are ON. With this case, the LED 4 is not lit, and LEDs 5 and 6 are lit. Similarly, in the period in which SO3 is ON, the sink-side switch SI1 is OFF and SI2 and SI3 are ON. With this case, the LED 7 is not lit and the LEDs 8 and 9 are lit.

Operation of Displayed Subframe 2 of Frame 1

Next, in the description below, the operation of display subframe 2 of frame 1 is illustrated. In this period, the virtual subframe of virtual subframe identification number 2 is displayed. Similarly, in order to display the image of gradation levels 3, 4, and 5 shown in FIG. 5D, which are intermediate gradation levels, the lighting pattern of the pixels required in virtual subframe 2, that is, required in display subframe 2, is such that switches are turned ON for in the case of gradation level 3 and turned OFF in the case of gradation levels 4 and 5. The operation of the switches is such that, as shown in the timing chart of FIG. 6A, while the source-side switches are successively switched in order of SO1, SO2, and SO3, the sink-side switch SI1 is maintained to be ON, and SI2 and SI3 are maintained to be OFF. More specifically, in the period where the source-side switch SO1 is ON, the sink-side switch SI1 is ON and SI2 and SI3 is OFF, which allows the LED 1 to be lit, and allows the LEDs 2 and 3 not to be lit. In the period where the source-side switch SO2 is ON, the sink-side switch SI1 is ON and SI2 and SI3 is OFF, which allows the LED 4 to be lit, and allows the LEDs 5 and 6 not to be lit. Further, in the period where the source-side switch SO3 is ON, the sink-side switch SI1 is ON and SI2 and SI3 is OFF, which allows the LED 7 to be lit and allows the LEDs 8 and 9 not to be lit.

Operation of Displayed Subframe 3 in Frame 1

In the subsequent display subframe 3 of frame 1, an image of the virtual subframe of virtual subframe identification number 3 is displayed. According to the subframe modulation table of FIG. 7, the lighting pattern is such that switches are turned OFF in the case of gradation level 3 and turned ON in the case of gradation levels 4 and 5, which is the same with that in the above-described displayed subframe 1 of frame 1. Accordingly, as a result of the operation same with that in the above-described displayed subframe 1, the LEDs 1, 4, and 7 are not lit, and the LEDs 2, 3, 5, 6, 8, and 9 are lit.

Operation of Displayed Subframe 4 of Frame 1

Further, in displayed subframe 4 of frame 1, an image of the virtual subframe of virtual subframe identification number 4 is displayed. According to the subframe modulation table in FIG. 7, the lighting pattern is such that switches are turned ON in the case of gradation levels 3 and 5 and turned OFF in the case of gradation level 4. As shown in the timing chart in FIG. 6A, the operation of each switch is such that, while the source-side switches are successively switched in order of SO1, SO2, and SO3, the sink-side switches SI1, SI3 are maintained to be ON, and S12 is maintained to be OFF. More specifically, in the period where the source-side switch SO1 is ON, the sink-side switches SI1 and SI3 are ON and S12 is OFF, so that the LEDs 1 and 3 are lit, and the LED 2 is not lit. In the period where the source-side switch SO2 is ON, the sink-side switches SI1 and SI3 are ON and S12 is OFF, which allows the LEDs 4 and 6 to be lit and allows the LED 5 not to be lit. Further, in the period where the source-side switch SO3 is ON, the sink-side switches SI1 and S13 are ON and SI2 are OFF, so that the LEDs 7 and 9 are lit and the LED 8 is not lit.

As described above, in frame 1, an image of the virtual subframes of virtual subframe identification numbers 1 to 4 as displayed subframes 1 to 4 are displayed, and an image of virtual subframes of virtual subframe identification numbers 5 to 7, which serves as the undisplayed subframes, are not shown. On the other hand, in the subsequent frame 2, the virtual subframes of virtual subframe identification numbers 5 to 7, the image of which is not shown in frame 1, are selected as display subframes 1 to 3. Further, as the rest displayed subframe 4 of the subsequent frame 2, an image of the virtual subframe of virtual subframe identification number 1 is displayed returning to the top of the virtual subframes. In the description below, the operations of display subframes 1 to 4 of frame 2 will be described.

Operation of Display Subframe 1 of Frame 2

First, in display subframe 1 of frame 2, an image of the virtual subframe of virtual subframe identification number 5 is displayed. According to the subframe modulation table of FIG. 7, the lighting pattern of virtual subframe 5 is such that switches are turned OFF in the case of gradation level 3 and switches are turned ON in the case of gradation levels 4 and 5, which is same with that in virtual subframes 1 and 3, that is, the above-described displayed subframes 1 and 3 of frame 1. Accordingly, as a result of the same operation with that in display subframes 1 and 3, the LEDs 1, 4, and 7 are not lit, and the LEDs 2, 3, 5, 6, 8, and 9 are lit.

Operation of Displayed Subframe 2 of Frame 2

Next, in displayed subframe 2 of frame 2, an image of the virtual subframe of virtual subframe identification number 6 is displayed. In virtual subframe 6, according to the subframe modulation table of FIG. 7, similarly to virtual subframe 2, the lighting pattern is such that switches are turned ON in the case of gradation level 3 and turned OFF in the case of gradation levels 4 and 5. Accordingly, the operation same with that in virtual subframe 2, that is, display subframe 2 of frame 1 is performed, so that the LEDs 1, 4, and 7 are lit and the LEDs 2, 3, 5, 6, 8, and 9 are not lit.

Operation of Displayed Subframe 3 of Frame 2

Next, in displayed subframe 3 of frame 2, an image of the virtual subframe of virtual subframe identification number 7 is displayed. In virtual subframe 7, according to the subframe modulation table in FIG. 7, similarly to virtual subframe 1, the lighting pattern is such that switches are turned OFF in the case of gradation level 3 and turned ON in the case of gradation levels 4 and 5. Accordingly, the operation same with that in virtual subframes 1, 3, and 5, that is, displayed subframes 1 and 3 of frame 1 and displayed subframe 1 of frame 2 is performed, so that the LEDs 1, 4, and 7 are not lit and LEDs 2, 3, 5, 6, 8, and 9 are lit.

Operation of Display Subframe 4 of Frame 2

Further, in display subframe 4 of frame 2, an image of the virtual subframe of virtual subframe identification number 1 is displayed again. With this arrangement, as described above, the operation in display subframe 1 of frame 1 displaying an image of virtual subframe 1 (or display an image of subframe 3 of frame 1 and display an image of subframes 1 and 3 of frame 2) is repeated, so that the LEDs 1, 4, and 7 are not lit and the LEDs 2, 3, 5, 6, 8, and 9 are lit.

In this manner, in display subframes 1 to 4 of frame 2, display of virtual subframes 5 to 7 and 1 are performed, and display of the rest virtual subframes 2 to 7 are not performed serving as the undisplayed subframes. In the present embodiment, the image of FIG. 5D is shown in both frames 1 and frame 2, so that the same image is shown in virtual subframes 1 to 7 of frame 1 and that of frame 2. Accordingly, displaying an image of virtual subframes 1 to 4 in frame 1 and virtual subframes 5 to 7 and 1 in the subsequent frame 2 is equivalent to repeatedly displaying an image using virtual subframes 1 to 7. Hence, although display of some of virtual subframes in each subframe is not performed, display of the undisplayed subframes is complemented in the successive frames, so that images in all subframes 1 to 7 are displayed in a composite image obtained by synthesizing images of these virtual subframes. Therefore, the user recognizes that the composite image in which a desired intermediate gradation level is apparently expressed is displayed.

A description of subsequent frames 3 to 7 is omitted, because these subframe are substantially the same with Frames 1 and 2 except for the virtual subframe identification numbers of the virtual subframes in each frame.

As described above, through a series of frames, a complete set of virtual subframes 1 to 7 appears in any successive two frames. In this manner, even in the case where the number of real subframes N for each frame is four, an image of gradation levels 0 to 7 can be displayed using N pieces of virtual subframes, the number of pieces which is greater than four, that is, using seven virtual subframes. Further, as shown in FIGS. 6A and 6B, through frames 1 to 7, virtual subframes 1 to 7 each appear four times. Accordingly, the LEDs 1, 4, and 7 showing the correct gradation, that is, the LEDs 1, 4, and 7 to be lit at gradation level 3, is lit in virtual subframes 2, 4, and 6, i.e., lit 12 times in total; the LEDs 2, 5, and 8 to be lit at gradation level 4 are lit in virtual subframes 1, 3, 5, and 7, i.e., lit 16 times in total; and the LEDs 3, 6, and 9 to lit at gradation level 5 are lit in virtual subframes 1, 3, 4, 5, and 7, i.e., lit 20 times in total. Thus, linearity of gradation levels is substantially maintained.

In the description below, the successive lighting patterns of frames 1 to 7 as described above in the case of other gradation levels are illustrated. According to subframe modulation table of FIG. 7, lighting is not performed in no virtual subframes in the case of gradation level 0, so that lighting is performed for zero times in total. Further, in the case of gradation level 1, lighting is performed in only virtual subframe 4, so that lighting is performed for four times in total in frames 1 to 7. Further, in the case of gradation level 2, lighting is performed in virtual subframes 2 and 6, so that lighting is performed for eight times in total. Still further, in the case of gradation level 6, lighting is performed in virtual subframes 1, 2, 3, 5, 6, and 7, so that lighting is performed for 24 times in total. In the case of gradation level 7, lighting is performed in all the virtual subframes, so that lighting is performed for 4×7=28 times in total.

As described above, with the display apparatus according to the first embodiment, a virtual subframe that serves as an undisplayed subframe in any one frame serves as a display subframe in other frame subsequent to the one frame. In this manner, an arrangement that the undisplayed subframe in one frame becomes the displayed subframe in the subsequent frame allows, even in the case where display of not all the virtual subframes can be performed in one frame, display of the virtual subframes are complemented in the subsequent frame. With this arrangement, an image of gradation level that can be displayed in virtual subframes in one frame is apparently displayed due to the afterimage effect. Therefore, multi-gradation is realized without substantially increasing the frame rate. For example, in the case where four displayed subframes are allocated to one frame, only gradation levels 0 to 4 can be expressed by the conventional method. In contrast, according to the present embodiment, gradation levels 0 to 7 can be expressed.

Second Embodiment

In the first embodiment described above, an exemplary case where the number of virtual subframes is seven is illustrated. However, in the present invention, M, which represents the number of virtual subframes, is not limited to be seven, but any natural number being greater than the number of display subframes N, which is the number of subframes really displayed in one frame period, can be employed. It is preferable that the number M is a power of 2, which allows for maintaining the linearity of gradation difference expressed on the display. Further, from other viewpoint, it is preferable that the relationship between M and N satisfies $M \leq 2N$, which allows all the virtual subframes (M pieces) to be displayed in two frames (2N pieces), and all the virtual subframes are completed in successive frames. Therefore, image of intermediate gradation that is formed due to the afterimage effect can be easily reproduced.

Figure 8A:
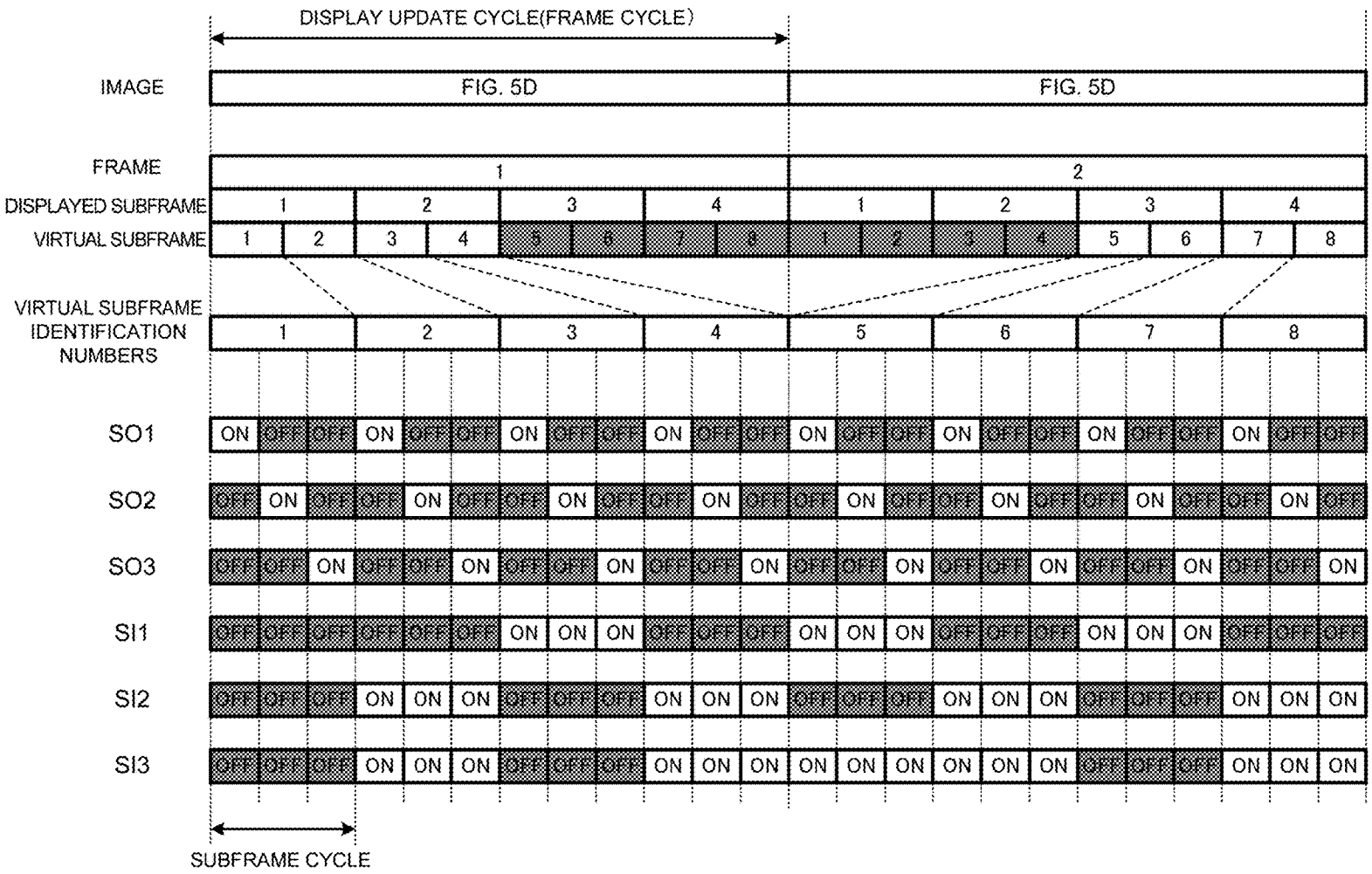
FIG. 8A is a timing chart of a lighting of a display apparatus with subframe modulation according to a second embodiment.
Figure 8B:
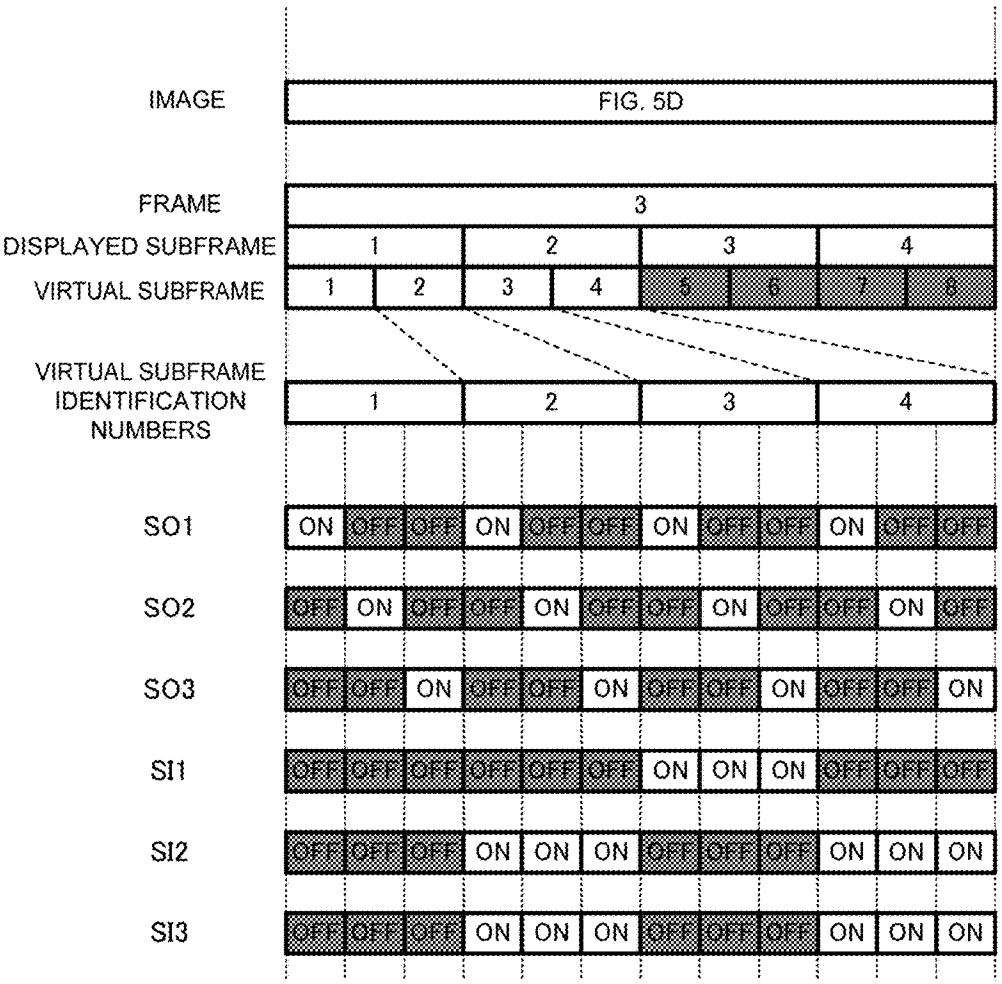
FIG. 8B is a timing chart continued from FIG. 8A.

Next, as a second embodiment, a display apparatus in which the number of virtual subframes M is eight is described, with reference to the timing charts of FIGS. 8A and 8B and the subframe modulation table of FIG. 9. In this exemplary case also, for each display update cycle, the image on the display is FIG. 5D→FIG. 5D→FIG. 5D→ . . . →FIG. 5D in order from frame 1 to show the same display content, i.e., a still image. In FIG. 5D, images of gradation levels 3, 4, and 5 in eight-gradation display of gradation levels 0 to 7, so that seven or more subframes are required for realizing such eight-gradation display. Among the number equal to or greater than 7 and a power of 2, the number closest to 7 is 8 (the third power of 2). Accordingly, in the second embodiment, eight virtual subframes are generated, which can display images of nine gradations of gradations 0 to 8. Further, the displayed subframes which can perform display in one frame are four, which is the same with the first embodiment. Therefore, in each frame, four virtual subframes out of the eight virtual subframes are selected and images of these four subframes are displayed as the displayed subframes.

In frame 1, virtual subframe identification numbers 1 to 8 are allocated to the eight virtual subframes generated for displaying the image of FIG. 5D. Out of the eight virtual subframes, four images of subframes with virtual subframe identification numbers 1 to 4 are displayed as displayed subframes 1 to 4, and four images with virtual subframe identification numbers 5 to 8 serves as the undisplayed subframes.

Next, in frame 2, similarly, out of the eight virtual subframes generated for displaying the image of FIG. 5D, four virtual subframes with virtual subframe identification numbers 5 to 8 are displayed as display subframes 1 to 4 of frame 2. The rest four virtual subframes with virtual subframe identification numbers 1 to 4 as the undisplayed subframes. In this manner, the image structured by a complete set of virtual subframes 1 to 8 is displayed on the display using two frames of frames 1 and 2.

Next, with reference to the subframe modulation table of FIG. 9, a specific exemplary case of subframe modulation for displaying the image of FIG. 5D on the display is described below. In the image displayed in FIG. 5D, according to the arrangement of pixels of FIG. 4, the LEDs 1, 4, and 7 are lit to express gradation level 3, the LEDs 2, 5, and 8 are lit to express gradation level 4, and the LEDs 3, 6, and 9 are lit to express gradation level 5. With subframe modulation of FIG. 9, when eight virtual subframes are generated to obtain the image of FIG. 5D, switches are turned ON in virtual subframes 3, 5, and 7, and switches are turned OFF in virtual subframes 1, 2, 4, 6, and 8 out of the eight virtual subframes, in order to realize the pixels of gradation level 3. Further, in order to realize the pixels of gradation level 4, switches are turned ON in virtual subframes 2, 4, 6, and 8, and switches are turned OFF in virtual subframes 1, 3, 5, and 7 out of the eight virtual subframes. Still further, in order to realize the pixels of gradation level 5, switches are turned ON in virtual subframes 2, 4, 5, 6, and 8, and switches are turned OFF in virtual subframes 1, 3, and 7.

Next, in order to realize such a lighting pattern, as shown in the timing chart of FIG. 8A, in frame 1, four virtual subframes of virtual subframe identification numbers 1 to 4 out of the eight virtual subframes are selected as displayed subframes 1 to 4, and images of these displayed subframes are displayed. Images of other subframes of virtual subframe identification numbers 5 to 8 serves as the undisplayed subframes. In the subsequent frame 2, four virtual subframes of virtual subframe identification numbers 5 to 8 out of the eight virtual subframes are selected as displayed subframes 1 to 4, and images of these displayed subframes are displayed, and other images of virtual subframe identification numbers 1 to 4 serves as the undisplayed subframes.

Displayed Subframe 1 of Frame 1

In each display subframes, the source-side switches SO1 to SO3 are time-divisionally turned ON in order, and the voltage is supplied to the common lines C1 to C3 from the voltage source V. In the description below, with reference to the timing chart of FIG. 8A, the operations are illustrated from display subframe 1 of frame 1. First, in displayed subframe 1, the source-side switches are switched in order of SO1, SO2, SO3. Here, in order to obtain the lighting pattern of virtual subframe 1, according to the subframe modulation table of FIG. 9, switches are turned OFF in virtual subframe 1 in the case of expressing gradation levels 3 to 5. Accordingly, although the LEDs 1 to 3 are originally to be controlled when the source-side switch SO1 is turned ON, the sink-side switches SI1 to SI3 are turned OFF, so that the LEDs 1 to 3 are not lit. Next, although the LEDs 4 to 6 are originally to be controlled when the source-side switch SO2 is turned ON, the sink-side switches SU to SI3 are turned OFF, so that the LEDs 4 to 6 are not lit. Further, although the LEDs 7 to 9 are originally to be controlled when SO3 is turned ON, similarly the sink-side switches SI1 to SI3 are turned OFF, so that the LEDs 7 to 9 are not lit.

Displayed Subframe 2 of Frame 1

Next, according to the subframe modulation table of FIG. 9, in displayed subframe 2 of frame 1, switches are OFF in the case of expressing gradation level 3, and are ON in the case of expressing gradation levels 4 and 5. Similarly to displayed subframe 1, as shown in the timing chart of FIG. 8A, in display subframe 2 also, the source-side switches are switched in order of SO1, SO2, SO3. More specifically, first, when the source-side switch SO1 is ON, the sink-side switch SD is OFF and the sink-side switches SI2 and SI3 are ON, so that the LED 1 is not lit and the LEDs 2 and 3 are lit. Next, when the source-side switch SO2 is ON, the sink-side switch SI1 is OFF and the sink-side switches SI2 and SI3 are ON, so that the LED 4 is not lit and the LEDs 5 and 6 are lit. Further, when the source-side switch SO3 is ON, the sink-side switch SI1 is OFF and the sink-side switches SI2 and SI3 are ON, so that the LED 7 is not lit and the LEDs 8 and 9 are lit.

Displayed Subframe 3 of Frame 1

Next, according to the subframe modulation table of FIG. 9, in displayed subframe 3 of frame 1, switches are ON in the case of expressing gradation level 3, and are OFF in the case of expressing gradation levels 4 and 5. Similarly to displayed subframe 1, as shown in the timing chart of FIG. 8A, in display subframe 3 also, the source-side switches are switched in order of SO1, SO2, SO3. More specifically, first, when the source-side switch SO1 is ON, the sink-side switch SI1 is ON and the sink-side switches SI2 and SI3 are OFF, so that the LED 1 is lit and the LEDs 2 and 3 are not lit. Next, when the source-side switch SO2 is ON, the sink-side switch SI1 is ON and the sink-side switches SI2 and SI3 are OFF, so that the LED 4 is lit and the LEDs 5 and 6 are not lit. Further, when the source-side switch SO3 is ON, the sink-side switch SI1 is ON and the sink-side switches SI2 and SI3 are OFF, so that the LED 7 is lit and the LEDs 8 and 9 are not lit.

Displayed Subframe 4 of Frame 1

Next, in display subframe 4 of frame 1, according to the subframe modulation table of FIG. 9, the lighting pattern is similar to that of display subframe 2. That is, the LEDs 1, 4, and 7 are not lit, and the LEDs 2, 3, 5, 6, 8, and 9 are lit.

Displayed Subframe 1 of Frame 2

Next, in display subframe 1 of frame 2, an image of virtual subframe 5 is displayed as an image of display subframe 1. According to the subframe modulation table of FIG. 9, in virtual subframe 5 of frame 2, switches are ON in the case of expressing gradation levels 3 and 5, and are OFF in the case of expressing gradation level 4. More specifically, first, when the source-side switch SO1 is ON, the sink-side switches SI1 and SI3 are ON and the sink-side switch SI2 is OFF, so that the LEDs 1 and 3 are lit and the LED 2 is not lit. Next, when the source-side switch SO2 is ON, the sink-side switches SD and SI3 are ON and the sink-side switch SI2 is OFF, so that the LEDs 4 and 6 are lit and the LED 5 is not lit. Further, when the source-side switch SO3 is ON, the sink-side switches SI1 and SI3 are ON and the sink-side switch SI2 is OFF, so that the LEDs 7 and 9 are lit and the LED 8 is not lit.

Display Subframe 2 of Frame 2

Next, in displayed subframe 2 of frame 2, an image of virtual subframe 6 is displayed as an image of displayed subframe 2. In virtual subframe 6, according to the subframe modulation table of FIG. 9, the lighting pattern is similar to that of display subframes 2 and 4 described above. That is, the LEDs 1, 4, and 7 are not lit and the LEDs 2, 3, 5, 6, 8, and 9 are lit.

Displayed Subframe 3 of Frame 2

Next, in displayed subframe 3 of frame 2, an image of virtual subframe 7 is displayed as an image of displayed subframe 3. In virtual subframe 7, according to the subframe modulation table of FIG. 9, the lighting pattern is similar to that of display subframe 3. That is, the LEDs 1, 4, and 7 are lit, and the LEDs 2, 3, 5, 6, 8, and 9 are not lit.

Displayed Subframe 4 of Frame 2

Next, in displayed subframe 4 of frame 2, an image of virtual subframe 8 is displayed as an image of displayed subframe 4. In virtual subframe 8, according to the subframe modulation table of FIG. 9, the lighting pattern is similar to that of display subframes 2, 4, and 6. That is, the LEDs 1, 4, and 7 are not lit, and the LEDs 2, 3, 5, 6, 8, and 9 are lit.

In the subsequent frame 3, since the subframe identification numbers of the virtual subframes selected as the displayed subframes are same with those in frame 1, the description thereof is omitted.

Lighting each of the LEDs in this manner allows for displaying all of virtual subframes 1 to 8, through frames 1 and 2. That is, even in the case where the number of real subframes structuring one frame is four, it becomes possible to express nine gradation levels of 0 to 8 gradation levels, which are greater than five gradation levels, by the real four subframes. Further, through frames 1 and 2 i.e., through a plurality of frames, virtual subframes 1 to 8 each appear once. Accordingly, it can be seen that the correct gradation is expressed. That is, according to the subframe modulation table of FIG. 9, the LEDs 1, 4, and 7 serving to realize gradation level 3 are lit in virtual subframes 3, 5, and 7, i.e., three times. Further, the LEDs 2, 5, and 8 serving to realize gradation level 4 are lit in virtual subframes 2, 4, 6, and 8, i.e., four times. Still further, the LEDs 3, 6, and 9 serving to realize gradation 5 are lit in virtual subframes 2, 4, 5, 6, and 8, i.e., five times. Thus, the linearity of gradation is substantially maintained.

Third Embodiment

In the first and second embodiments described above, the image to be displayed is a still image in which the same image is displayed in frame 1 and frame 2. With this arrangement, the virtual subframes having not been displayed in one frame are displayed in the subsequent frame, so that no undisplayed virtual subframes are generated. However, with this method, in the case where different images are displayed between frame 1 and frame 2 such as a moving image in which figures or characters scroll, an images of a virtual subframe which is not displayed as an image of the undisplayed subframes, among the virtual subframes structuring one frame. Therefore, in the description below, as the structure with which an virtual subframe image (or subframe identification numbers corresponding thereto) being not displayed are less likely to be generated for each image, a display apparatus according to a third embodiment will be illustrated with reference to the timing charts of FIGS. 10, 11A, and 11B.

Pulse Width Modulation

In the display apparatus according to the third embodiment, pulse width modulation (PWM) is performed within a subframe. In the first and second embodiments described above, the number of gradation levels which can be expressed in each image corresponds to the total number of subframes. On the other hand, in the present embodiment, the number of gradation levels obtained by synthesizing the gradation levels of each image and dot correction levels corresponds to the number obtained by synthesizing the total number of subframes and the number of pulse width modulation levels.

Dot Correction

In the present embodiment, dot correction is referred to as uniforming brightness of LEDs such that the LEDs emit light at substantially the same brightness in the case where gradation levels of the LEDs in each image are identical. In this exemplary case, in order to correspond brightness of the LEDs, time of lighting the LEDs is modulated to perform dot correction. Note that, in place of modulating time of lighting the LEDs, driving current for driving LED can be used for dot correction.

Surface Brightness

Note that, in the description below, an exemplary case where a dot correction level is composed with a gradation level in each image, the present invention is not limited thereto. For example, in place of or in addition to a dot correction level, surface brightness may be composed with a gradation level. Here, surface brightness is a parameter in which the brightness of a plurality of predetermined LEDs (a block made of LEDs) is changed at the same proportion. For example, the surface brightness is applied for each color of R, G, and B.

In this exemplary case, dot correction and image respectively have a gradation of nine levels of 0 to 8. When these numbers of gradation levels are composed, 8×8=64 is obtained at the maximum, which is 1000000 in binary number, that is, 7 bits. In the description below, an exemplary case where subframe modulation is performed with 3 bits and the pulse width modulation is performed with 4 bits.

Exemplary Case where Shifting of Gradation is Visually Followed: Gradation Level 3

Figure 10:
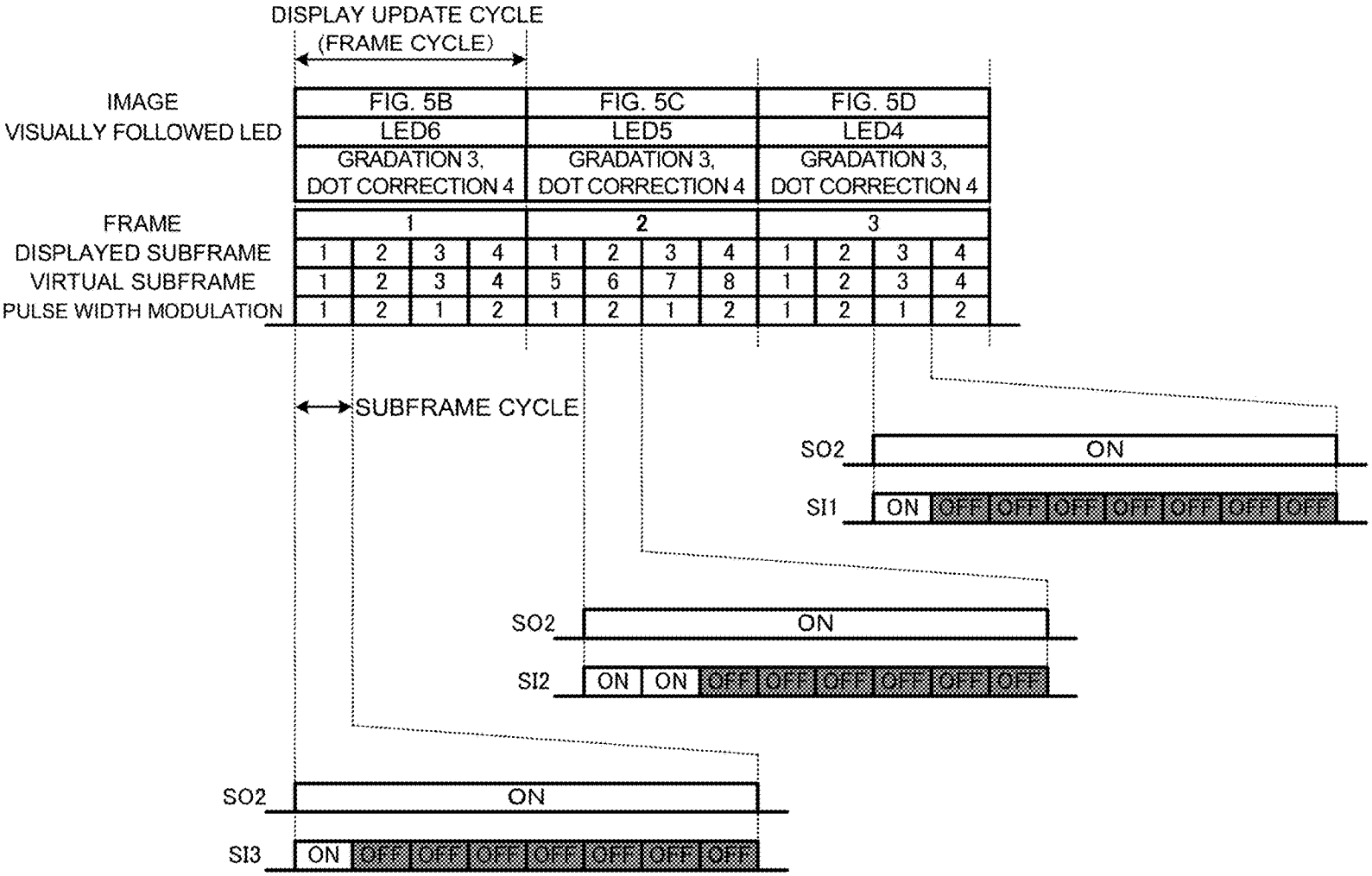
FIG. 10 is a timing chart of an exemplary lighting of a display apparatus in the case where shifting of gradations of a display apparatus according to a third embodiment is visually observed.

Next, FIG. 10 is a timing chart of an exemplary case where shifting of gradation of an image displayed on the display apparatus according to the third embodiment is visually followed. In the exemplary case illustrated here, lighting of gradation level 3, that is, lighting of the LED 6→the LED 5→the LED 4 (the LEDs in the second row in display in FIGS. 5B, 5C, and 5D) is visually followed in the case where the images of FIG. 5A to FIG. 5H are displayed in order of FIG. 5A→FIG. 5B→FIG. 5C→FIG. 5D→FIG. 5E→FIG. 5F→FIG. 5G→FIG. 5H (may return to FIG. 5A and repeat) from frame 1 as scrolling leftward. Note that, since control of the source drivers and the sink drivers is similar to FIGS. 6A, 6B and the like according to the first embodiment, a part of the chart is not shown in the drawing for the sake of convenience.

Subframe Modulation Including Dot Correction

With reference to the subframe modulation table of FIG. 12, in the description below, an exemplary case where subframe modulation is performed in the display apparatus according to the third embodiment. This subframe modulation table shows that whether +0 or +1 is added to lower order bits by subframe modulation. Here, for the sake of convenience, the dot correction level for each of the LEDs is uniformly 4. In the description below, an exemplary case where the image of FIG. 5B is displayed on the display is illustrated. In the LEDs arranged in 3×3 matrix structuring the display, a data of gradation level 3 is to be input to the LED 6, which is positioned at the second row and the third column of the matrix. As described above, the dot correction level of the LED is 4, so that, when these numbers of levels are composed, 3 (gradation level)×4 (dot correction level)=12 is obtained. This obtained number 12, which is the composed level, is expressed as 0001100 in binary number. This binary number is split into higher order 4 bits (value 0001) and lower order 3 bits (value 100). Subframe modulation is performed with these lower order 3 bits.

According to the subframe modulation table of FIG. 12, in the case where the value of lower order 3 bits is 100 (the fourth row in the table of FIG. 12), the level of subframe modulation with respect to the virtual subframes 1 to 8 is 0, +1, 0, +1, 0, +1, 0, +1, respectively. Hence, among virtual subframes 1 to 8, modulation level of +0 is performed in virtual subframes 1, 3, 5 and 7, and therefore 0 is added to the value of higher order 4 bits 0001 (or the value is maintained). As a result, the value of 0001+0=0001 is obtained, that is, in decimal number, the gradation level is 1, so that the pulse width modulation level 1 is obtained. In summary, in order to express gradation level 3 and dot correction level 4, the LED 6 is lit with pulse width modulation level 1 in virtual subframes 1, 3, 5, and 7 (see the row of "pulse width modulation" in FIG. 10).

On the other hand, the level of subframe modulation with respect to virtual subframes 2, 4, 6, and 8 is +1. Therefore, +1 is added to the value 0001 of higher order 4 bits, and as a result, 0001+1=0010 is obtained, which is expressed as 2 in decimal number, so that pulse width modulation level 2 is obtained. In summary, in order to represent gradation level 3 and dot correction level 4, the LED 6 is lit with pulse width modulation level 2 in virtual subframes 2, 4, 6, and 8 (see the row of "pulse width modulation" in FIG. 10).

FIG. 10: Frame 1

Returning to the discussion of generation and display of virtual subframes, in the third embodiment also, similarly to the second embodiment, virtual subframes 1 to 4 out of the eight virtual subframes are selected as displayed subframes 1 to 4 in frame 1, and lighting in these displayed subframes is performed. Accordingly, as shown in FIG. 10, in virtual subframes 1 and 3, display of gradation level 1, i.e., display in which pulse width modulation level is 1 is performed. On the other hand, in virtual subframes 2 and 4, display of gradation level 2, i.e., display in which pulse width modulation level is 2 is performed.

As to control of the source drivers and the sink drivers in virtual subframe 1, actually the source-side switches are time-divisionally ON in order of SO1→SO2→SO3. However, in the description below, the case of lighting solely the LED 6 is illustrated, so that the timing chart of FIG. 10 shows just the operation of the source-side switch SO2 and the sink-side switch SI3. In the description below, with reference to FIG. 10, the operation of the LED 6 in display subframe 1 of frame 1 is illustrated. In frame 1, in order to display the image of FIG. 5B, that is, the display of gradation level 3 and dot correction level 4 with the LED 6, lighting of the LED 6 is controlled in the section where the source-side switch SO2 is ON so that pulse width modulation level 1 is obtained by pulse width modulation. Also, in order to realize pulse width modulation of nine levels, one subframe period is divided into eight sections. Further, in order to light the LED 6 with pulse width modulation level 1, among eight sections of the subframe period in display subframe 1 in which the source-side switch SO2 is ON, the sink-side switch SI3 is ON only in one section, and the sink-side switch SI3 is OFF in the other seven sections. In this exemplary case, the sink-side switch SI3 is ON in the top section. Note that, in the present embodiment, a description of the operation of the other virtual subframes 2 to 4 of frame 1 is omitted.

FIG. 10: Frame 2

Next, in frame 2, when the pixel of gradation 3 is visually followed with, as shown in FIG. 5C, the pixel shifts from the LED 6 to the LED 5. In the image of FIG. 5C, since a data of gradation level 3 and dot correction level 4 is input to the LED 5, synthesizing these values, 3 (gradation levels)×4 (dot correction levels)=12 is obtained. With this, the lighting identical to the above-described frame 1 can be obtained.

In the description below, the operation of displaying virtual subframe 6 in display subframe 2 out of display subframes 1 to 4 of frame 2 is illustrated. As to control of the source drivers and the sink drivers in virtual subframe 6 also, actually the source-side switches are time-divisionally ON in order of SO1→SO2→SO3. However, in the description below, driving of solely lighting the LED 5 is illustrated, so that FIG. 10 shows just the operation of the source-side switch SO2 and the sink-side switch SI2. In the description below, with reference to FIG. 10, the operation of the LED 5 in display subframe 2 (virtual subframe 6) of frame 2 is illustrated. As described above, in virtual subframe 6, the LED 5 must be lit such that gradation level 2, that is, pulse width modulation level 2 is attained. In order to achieve this, in the section where the source-side switch SO2 is ON, in accordance with pulse width modulation 2, the sink-side switch SI2 is ON only in two sections out of the eight lighting periods, and OFF in other six sections. Also in frame 2, the sink-side switch SI2 is ON in the top two sections in the eight lighting periods. Note that, a description of the operation of display subframes 1, 3, and 4 (virtual subframes 5, 7, and 8) of frame 2 is omitted.

FIG. 10: Frame 3

Similarly, in frame 3, the pixel of gradation level 3 shifts to the LED 4 as shown in FIG. 5D. In frame 3, since a data of gradation level 3 and dot correction level 4 is input to the LED 4, synthesizing the values, 3 (gradation level)×4 (dot correction level)=12 is obtained. With this, the lighting identical to the above-described frames 1 and 2 can be obtained.

In the description below, the operation of displaying virtual subframe 3 in display subframe 3 out of display subframes 1 to 4 of frame 3 is illustrated. Also as to control of the source drivers and the sink drivers in virtual subframe 3, actually the source-side switches are time-divisionally ON in order of SO1→SO2→SO3. However, in the description below, the case of lighting solely the LED 4, FIG. 10 shows just the operation of the source-side switch SO2 and the sink-side switch SI1. With reference to FIG. 10, the operation of the LED 4 in display subframe 3 (virtual subframe 3) of frame 3 is illustrated below. As described above, as shown in FIG. 10, since virtual subframe 3 corresponds to gradation level 1, the LED 4 is lit so that pulse width modulation amount level 1 is attained. In order to achieve this, in the section where the source-side switch SO2 is ON, in accordance with pulse width modulation amount level 1, the sink-side switch SI1 is ON only in one section out of the eight lighting periods, and is OFF in the other seven sections. In this exemplary case also, the sink-side switch SI1 is ON in the top one section out of the eight lighting periods. Note that, a description of the operation of displayed subframes 1, 2, and 4 (virtual subframes 1, 2, and 4) of frame 3 is omitted.

As described above, in the case where bar-like figures having different gradation levels are scrolled leftward on the display, pulse width modulation amount levels in four display subframes structuring each of the frames becomes 1, 2, 1, 2 in every frame when the user visually follows lighting of gradation level 3. Accordingly, when lighting of gradation level 3, that is, the LED 6→the LED 5→the LED 4 is visually followed, it is recognized that a point of constant brightness is shifting. In other words, according to the present embodiment, even in a scrolling moving image not being a still image, an image in which gradation conversion and dot correction is performed can be apparently expressed. That is, without accelerating the subframe period and with undisplaying some of virtual subframes, display of gradation of a displayed image and dot correction of the displayed image can be substantially maintained.

Exemplary Case where Changes in Gradation of LED is Followed with Eyes: Pixel Position of LED 6

Figure 11A:
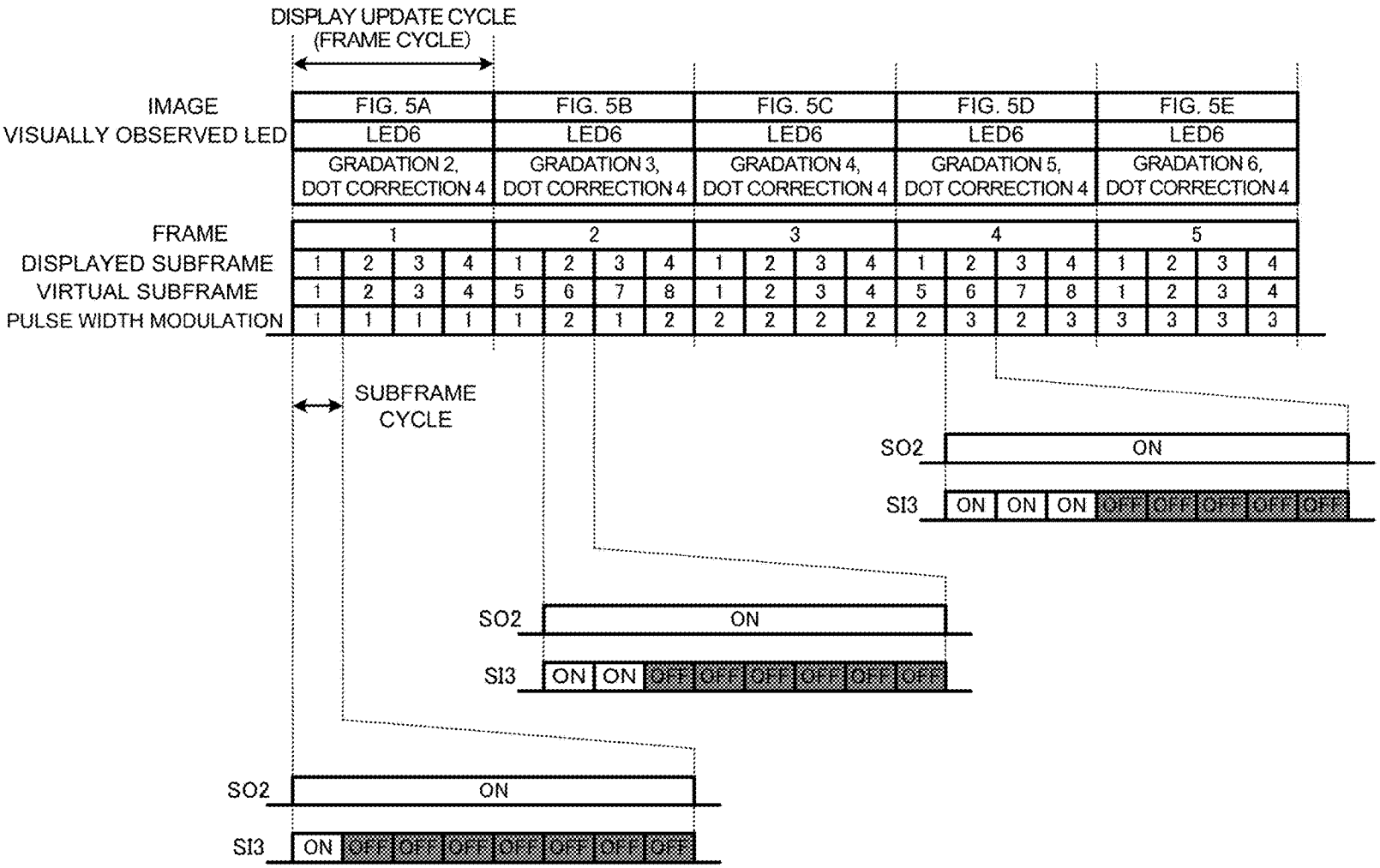
FIG. 11A is a timing chart of an exemplary lighting of a display apparatus in the case where shifting of gradations of LEDs of the display apparatus according to the third embodiment is visually observed.

In the description above, the case where the movement of pixels having an identical gradation level is visually followed by the user. Next, a timing chart of an exemplary case of visually observing changes in gradation levels of an LED in the same display apparatus according to the third embodiment is illustrated in FIG. 11A. In the description below, the case of observing the pixel of the LED 6 at the leftward-scrolling display of images in FIG. 5A to FIG. 5H in order of FIG. 5A→FIG. 5B→FIG. 5C→FIG. 5D→FIG. 5E→FIG. 5F→FIG. 5G→FIG. 5H from frame 1. Note that, in FIG. 11A, control of the source drivers and the sink drivers is similar to that shown in FIGS. 6A, 6B and the like according to the first embodiment described above, so that a part of the chart is omitted for the sake of convenience. Further, in this exemplary case also, for the sake of easy explanation, dot correction level of the LED 6 is set to be 4.

FIG. 11A: Frame 1

Firstly, in frame 1, the image of FIG. 5A is displayed on the display. Among the pixels for the image, the LED 6 is determined to have gradation level 2 and dot correction level 4. Synthesizing these values, 2 (gradation level)×4 (dot correction level)=8 is obtained. This obtained value 8, which is the composed level, is represented as 0001000 in binary number. This binary number is split into higher order 4 bits (value 0001) and lower order 3 bits (value 000), and subframe modulation is performed with the lower order 3 bits. According to the subframe modulation table of FIG. 12, in the case where the value of lower order 3 bits is 000, the modulation level is 0 for each of virtual subframes 1 to 8. Accordingly, with respect to all the virtual subframes 1 to 8, +0 is added to the value 0001 of the higher order 4 bits. Thus, gradation level 1 (0001+0=0001) is obtained, so that pulse width modulation level 1 is obtained.

As shown in the timing chart of FIG. 11A, in frame 1, out of the eight virtual subframes, virtual subframes 1 to 4 are selected as displayed subframes 1 to 4. In each of displayed subframes 1 to 4 (virtual subframes 1 to 4), display of gradation level 1, that is, display of pulse width modulation level 1, is performed.

More specifically, first, as to control of the source drivers and the sink drivers in displayed subframe 1, actually the source-side switches are time-divisionally ON in order of SO1→SO2→SO3. However, in the description below, solely the pixel position of the LED 6 is illustrated, so that just the operation of the source-side switch SO2 and the sink-side switch SI3 is illustrated in FIG. 11A. In this exemplary case, in order to perform pulse width modulation, one subframe period is divided into eight sections. Then, in order to realize pulse width modulation level 1, while the source-side switch SO2 is ON in this subframe period, the sink-side switch SI3 is ON just in one section out of the eight lighting periods and is OFF in the other seven sections. In this exemplary case, the sink-side switch SI3 is ON in the top section. Note that, in other display subframes 2 to 4 of frame 1, pulse width modulation is performed with pulse width modulation level 1 similarly to display subframe 1. Therefore, the description of the operation thereof is omitted.

FIG. 11A: Frame 2

Next, in frame 2, the image of FIG. 5B is displayed on the display. Among the pixels for the image, the LED 6 is determined to have gradation level 3 and dot correction level 4. Synthesizing these values, 3 (gradation level)×4 (dot correction)=12 is obtained. This obtained value 12, which is the composed level, is represented as 0001100 in binary number. This binary number is split into higher order 4 bits (value 0001) and lower order 3 bits (value 100). Subframe modulation is performed with these lower order 3 bits. According to the subframe modulation table of FIG. 12, in the case where the value of lower order 3 bits are 100, among virtual subframes 1 to 8, the modulation level of virtual subframes 1, 3, 5, and 7 is +0 and that of virtual subframes 2, 4, 6, and 8 is +1. Accordingly, the modulation level is 0 for virtual subframes 1, 3, 5, and 7, so that gradation level 1 (0001+0=0001) can be obtained from value 0001 of the higher order 4 bits, and thus pulse width modulation level 1 is obtained. On the other hand, the modulation level is +1 for virtual subframes 2, 4, 6, and 8. Hence, 1 is added to value 0001 of the higher order 4 bits, so that gradation level 2 (0001+1=0010) is obtained. That is, pulse width modulation level 2 is obtained.

On the other hand, in frame 2, out of eight virtual subframes 1 to 8, virtual subframes 5 to 8 are selected as displayed subframes 1 to 4 and lighting is performed in these displayed subframes. In these virtual subframes 5 to 8, subframe modulation of FIG. 12 as described above is performed. As a result, as shown in FIG. 11A, display of gradation level 1, i.e., display of pulse width modulation level 1, is performed in virtual subframes 5 and 7. Display of gradation 2, i.e., pulse width modulation 2, is performed in virtual subframes 6 and 8.

In the description below, the operation of displaying an image of virtual subframe 6 as displayed subframe 2. As to control of the source drivers and the sink drivers in displaying display subframe 2 (virtual subframe 6) in frame 2, actually the source-side switches are time-divisionally ON in order of SO1→SO2→SO3. However, in the description below, the case of lighting solely the LED 6 is illustrated, so that the timing chart of FIG. 11A illustrates just the operation of the source-side switch SO2 and the sink-side switch SI3. In virtual subframe 6 included in displayed subframe 2, the LED 6 is lit with pulse width modulation level 2. In order to achieve this, in the state where one subframe period is divided into eight sections, while the source-side switch SO2 is ON, the sink-side switch SI3 is ON in just two sections out of the eight lighting periods, and OFF in the other six sections. Also in this case, the sink-side switch SI3 is ON in the top two sections. Note that, in other virtual subframes 5, 7 and 8 of frame 2, the pulse width modulation level is 1 or 2 and the operation is similar to that described above. Therefore, a description thereof is omitted.

FIG. 11A: Frame 3

Further, in frame 3, the image of FIG. 5C is displayed on the display. The LED 6 for this image is determined to have gradation level 4 and dot correction 4. Synthesizing these values, 4 (gradation level)×4 (dot correction level)=16 is obtained. This obtained value 16, which is the composed level, is represented as 0010000 in binary number. This binary number is split into higher order 4 bits (value 0010) and lower order 3 bits (value 000), and subframe modulation is performed with the lower order 3 bits. According to the subframe modulation table of FIG. 12, in the case where the value of the lower order 3 bits is 000, the modulation level is +0 in each of virtual subframes 1 to 8. Hence, as to all the virtual subframes 1 to 8, the value 0010 of the higher order 4 bits is maintained, that is, gradation level 2 (0010+0=0010) is obtained, so that pulse width modulation level 2 is obtained.

As shown in the timing chart of FIG. 11A, in frame 3, out of the eight virtual subframes, virtual subframes 1 to 4 are again selected as displayed subframes 1 to 4. With these display subframes 1 to 4 (virtual subframes 1 to 4), display of gradation level 2, that is, display of pulse width modulation level 2, is performed.

Since control of the source drivers and the sink drivers in display subframes 1 to 4 is similar to that in the above-described case where pulse width modulation level is 2 in displayed subframe 2 (virtual subframe 6) of frame 2, a description thereof is omitted.

FIG. 11A: Frame 4

Further, in frame 4, the image of FIG. 5D is displayed on the display. In this image, LED 6 is determined to have gradation level 5 and dot correction 1 level 4. Synthesizing these values, 5 (gradation level)×4 (dot correction)=20 is obtained. This obtained value 20, which is the composed level, is represented as 0010100 in binary number. This value is split into higher order 4 bits (value 0010) and lower order 3 bits (value 100). When subframe modulation is performed with the lower order 3 bits, according to the subframe modulation table of FIG. 12, in the case where the value of the lower order 3 bits are 100, the modulation level is +0 in virtual subframes 1, 3, 5, and 7 out of the eight virtual subframes, and +1 in virtual subframes 2, 4, 6, 8. Accordingly, in virtual subframes 1, 3, 5, and 7, the value 0010 of the higher order 4 bits is maintained, so that gradation level 2 (0010+0=0010) is obtained, that is, pulse width modulation level 2 is obtained. On the other hand, since the modulation level is +1 for virtual subframes 2, 4, 6, and 8, +1 is added to the value 0010 of the higher order 4 bits. Accordingly, gradation level 3 (0010+1=0011) is obtained, so that pulse width modulation level 3 is determined.

As shown in the timing chart of FIG. 11A, in frame 4, out of the eight virtual subframes, virtual subframes 5 to 8 are selected as displayed subframes 1 to 4. With virtual subframes 5 and 7, display of gradation level 2, that is, display of pulse width modulation 2, is performed. With virtual subframes 6 and 8, display of gradation level 3, that is, display of pulse width modulation 3, is performed.

Control of the source drivers and the sink drivers for displaying virtual subframe 6 using displayed subframe 2 in frame 4 is such that, actually, the source-side switches are time-divisionally ON in order of SO1→SO2→SO3. However, in FIG. 11A, since driving of solely the LED 6 is illustrated, just the operation of the source-side switch SO2 and the sink-side switch SI3 is illustrated. In the section where the source-side switch SO2 is ON, by pulse width modulation, the sink-side switch SI3 is ON in the top three sections corresponding to pulse width modulation level 3 out of the eight lighting periods, and is OFF in other five sections. Note that, the operation of other virtual subframes 5, 7 and 8 is the same with that in the above-described case where pulse width modulation is 2 and 3. Therefore, a description thereof is omitted.

FIG. 11A: Frame 5

Further, in frame 5, the image of FIG. 5E is displayed on the display. In this image, the LED 6 is determined to have the gradation level 6 and dot correction level 4. Synthesizing these values, 6 (gradation level)×4 (dot correction level)=24 is obtained. This obtained value 24, which is the composed level, is represented as 0011000 in binary number. This binary number is split into higher order 4 bits (value 0011) and lower order 3 bits (value 000), and subframe modulation is performed with the lower order 3 bits. According to the subframe modulation table of FIG. 12, when the value of the lower order 3 bits is 000, the modulation level is 0 for each of virtual subframes 1 to 8. Accordingly, as to all the virtual subframes 1 to 8, the value 0011 of the higher order 4 bits is +0, that is, maintained as it is. Thus, gradation level 3 (0011+0=0011) is obtained, so that pulse width modulation level 3 is obtained.

As shown in the timing chart of FIG. 11A, in frame 5, out of the eight virtual subframes, virtual subframes 1 to 4 are selected as displayed subframes 1 to 4. With virtual subframes 1 to 4, display of gradation level 3, that is, display with pulse width modulation 3, is performed. Note that, since control of the source drivers and the sink drivers in virtual subframes 1 to 4 in this case is same with that in the above-described case where pulse width modulation level is 3, a description thereof is omitted.

FIG. 11B: Frame 6

Similarly, in frame 6, the image of FIG. 5F is displayed on the display. In this image, the LED 6 is determined to have gradation level 7 and dot correction level 4. Synthesizing these values, 7 (gradation level)×4 (dot correction) =28 is obtained. This obtained value 28, which is the composed level, is represented is 0011100 in binary number. This value is split into higher order 4 bits (value 0011) and lower order 3 bits (value 100), and subframe modulation is performed with the lower order 3 bits. According to the subframe modulation table of FIG. 12, in the case where the value of the lower order 3 bits is 100, for virtual subframes 1 to 8, the modulation level is +0 for virtual subframes 1, 3, 5, and 7, and +1 for virtual subframes 2, 4, 6, and 8. Accordingly, in virtual subframes 1, 3, 5, and 7, gradation level 3 (0011+0=0011) is obtained from the value 0011 of the higher order 4 bits, so that pulse width modulation 3 is obtained. On the other hand, in virtual subframes 2, 4, 6, and 8, +1 is added to the value 0011 of the higher order 4 bits, so that gradation level 4 (0011+1=0100), that is, pulse width modulation level 4, is obtained.

Figure 11B:
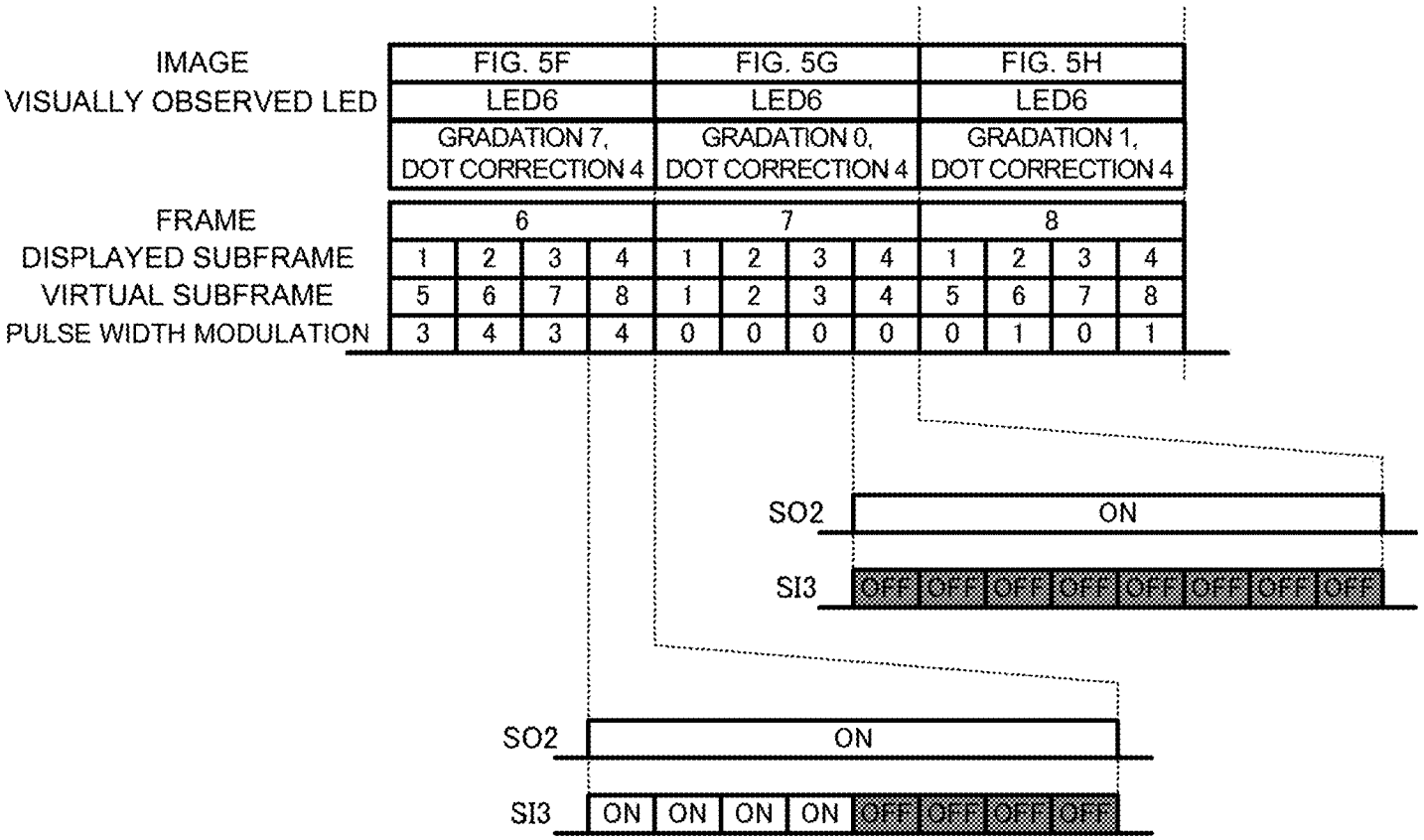
FIG. 11B is a timing chart continued from FIG. 11A.

As shown in the timing chart of FIG. 11B, in frame 6, out of the eight virtual subframes, virtual subframes 5 to 8 are selected as displayed subframes 1 to 4. With virtual subframes 5 and 7, display of gradation level 3, that is, display of pulse width modulation level 3, is performed. On the other hand, with virtual subframes 6 and 8, display of gradation level 4, that is, display of pulse width modulation 4, is performed.

In the description below, the operation for displaying virtual subframe 8 in displayed subframe 4 is illustrated. Control of the source drivers and the sink drivers is such that, actually, the source-side switches are time-divisionally ON in order of SO1→SO2→SO3. However, since driving of solely the LED 6 is illustrated below, in FIG. 11B, just the operation of the source-side switch SO2 and the sink-side switch SI3 is illustrated. While the source-side switch SO2 is ON, by pulse width modulation, the sink-side switch SI3 is ON in the top four sections corresponding to pulse width modulation level 4 out of the eight lighting periods, and is OFF in the other four sections. Note that, the operation of other virtual subframes 5 to 7 is the same with that in the above-described case where pulse width modulation is 3 or 4. Therefore, a description thereof is omitted.

FIG. 11B: Frame 7

Similarly, in the case where the image of FIG. 5G is displayed in frame 7, among the pixels for this image, the LED 6 is determined to have a gradation level 0 and dot correction level 4. Synthesizing these values, 0 (gradation level)×4 (dot correction level)=0 is obtained. This obtained value 0, which is the composed level, is represented as 0000000 in binary number. This binary number is split into higher order 4 bits (value 0000) and lower order 3 bits (value 000). Subframe modulation is performed with the lower order 3 bits. According to the subframe modulation table of FIG. 12, in the case where the value of the lower order 3 bits is 000, the modulation level is 0 for each of virtual subframes 1 to 8. Accordingly, as to all the virtual subframes 1 to 8, the value 0000 of the higher order 4 bits is maintained. Thus, gradation 0 (0000+0=0000) is obtained, so that pulse width modulation level o is obtained in all subframes.

As shown in the timing chart of FIG. 11B, in frame 7, out of the eight virtual subframes, virtual subframes 1 to 4 are selected as displayed subframes 1 to 4. With virtual subframes 1 to 4, display of gradation level 0, that is, display of pulse width modulation 0, is performed.

For example, in view of control of the source drivers and the sink drivers in displayed subframe 4 in frame 7, actually the source-side switches are time-divisionally ON in order of SO1→SO2→SO3. However, in the description below, since driving of solely the LED 6 is illustrated, so that just the operation of the source-side switch SO2 and the sink-side switch SI3 is illustrated in FIG. 11B. In the section where the source-side switch SO2 is ON, by pulse width modulation, pulse width modulation level 0 is performed. That is, the sink-side switch SI3 is OFF in all the eight lighting periods. Note that, since the operation of other virtual subframes 1 to 3 is the same with that in virtual subframe 4 described above, a description thereof is omitted.

FIG. 11B: Frame 8

Finally, in frame 8, the image of FIG. 5H is displayed. Among the pixels for the image, the LED 6 is determined to have gradation level 1 and dot correction level 4. Synthesizing the obtained values, 1 (gradation level)×4 (dot correction level)=4 is obtained. This obtained value 4, which is the composed level, is represented as 0000100 in binary number. This binary number is split into higher order 4 bits (value 0000) and lower order 3 bits (value 100), and subframe modulation is performed with the lower order 3 bits. According to the subframe modulation table of FIG. 12, in the case where the value of the lower order 3 bits is 100, among virtual subframes 1 to 8, the modulation level is +0 for virtual subframes 1, 3, 5, and 7, and the value 0000 of the higher order 4 bits is maintained, so that gradation level 0 (0000+0=0000) is obtained, that is, pulse width modulation level 0 is obtained. On the other hand, since the modulation level for virtual subframes 2, 4, 6, and 8 is +1, it is added to the value 0000 of the higher order 4 bits, so that gradation level 1 (0000+1=0001), that is, pulse width modulation level 1 is obtained.

As shown in the timing chart of FIG. 11B, in frame 8, out of the eight virtual subframes, virtual subframes 5 to 8 are selected as display subframes 1 to 4. With virtual subframes 5 and 7, display of gradation level 0, that is, display with pulse width modulation level 0, is performed. On the other hand, with virtual subframes 6 and 8, display of gradation 1, that is, display of pulse width modulation 1, is performed. Note that, since control of the source drivers and the sink drivers in virtual subframes 5 to 8 is similar to that in the above-described case where pulse width modulation level is 0 or 1, a description thereof is omitted.

As described above, when lighting of the LED 6 is visually followed, pulse width modulation in four displayed subframes in each frame is as follows; in frame 1, with respect to gradation level 2, pulse width modulation level is 1, 1, 1, 1 in four displayed subframes, respectively, i.e., four levels in total; in frame 2, with respect to gradation level 3, pulse width modulation level is 1, 2, 1, 2 in four displayed subframes, respectively, i.e., six levels in total; in frame 3, with respect to gradation level 4, pulse width modulation level is 2, 2, 2, 2 in four displayed subframes, respectively, i.e., eight levels in total; in frame 4, with respect to gradation level 5, pulse width modulation level is 2, 3, 2, 3 in four displayed subframes, respectively, i.e., ten levels in total; in frame 5, with respect to gradation level 6, pulse width modulation level is 3, 3, 3, 3 in four displayed subframes, respectively, i.e., twelve levels in total; in frame 6, with respect to gradation level 7, pulse width modulation level is 3, 4, 3, 4 in four displayed subframes, respectively, i.e., fourteen levels in total; in frame 7, with respect to gradation level 0, pulse width modulation level is 0, 0, 0, 0 in four displayed subframes, respectively, i.e., zero in total; and in frame 8, with respect to gradation level 1, pulse width modulation level is 0, 1, 0, 1 in four displayed subframes, respectively, i.e., two levels in total. In this manner, when the gradation level is raised by one, the pulse width is increased by two times greater, i.e., by two levels. Thus, it is confirmed that linearity of the pulse width is realized. Accordingly, when the user visually follows lighting of the LED 6, gradual changes in brightness can be recognized.

In this manner, even in the case of displaying images which differs in each display update cycle, not only with simply displaying images of the displayed subframes, but also with expressing gradation levels also in each displayed subframe using pulse width modulation or the like, generation of undisplayed subframes for displaying each image among subframes for displaying each image is reduced. That is, even in the case where a complete set of virtual subframe identification numbers appears in a cycle of 30 Hz or smaller and the display update cycle is 120 Hz or greater, linearity of gradation levels can be kept easily. Particularly in a display using the visual afterimage effect such as scrolling, for increasing numbers of gradation levels, expression of gradation levels in each subframes is preferably used.

Fourth Embodiment

Figure 13:
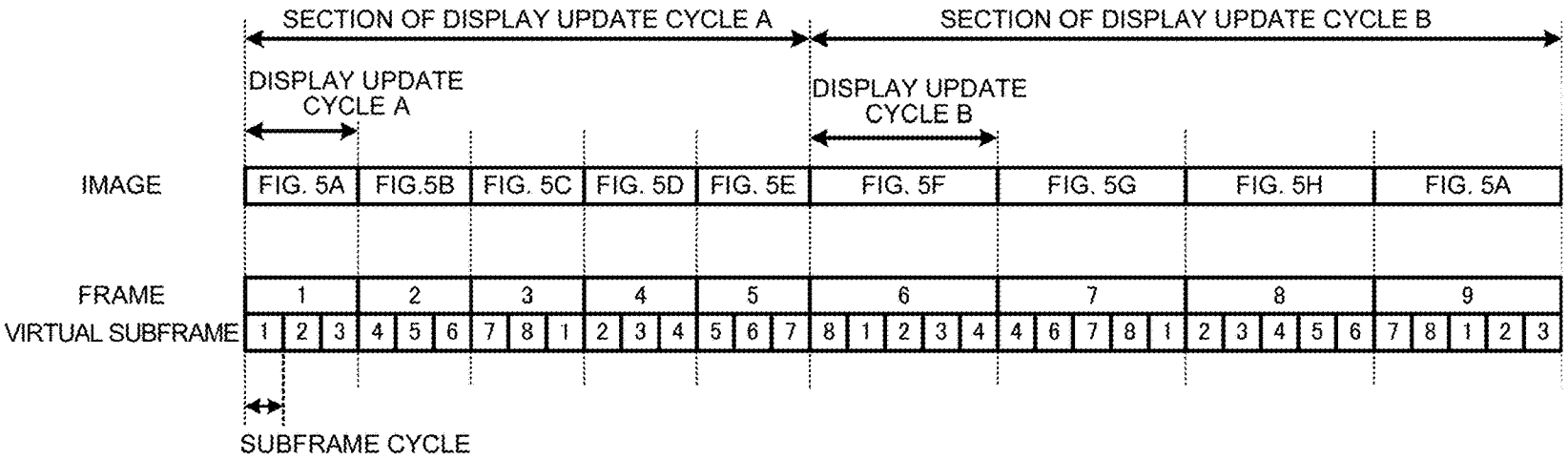
FIG. 13 is a timing chart of a lighting of a display apparatus with subframe modulation according to a fourth embodiment.

In the exemplary cases described below, the operation in which the display update cycle is fixed is illustrated. However, the present invention is not limited to such operation, and length of the display update cycle can be variable. Such an exemplary case will be described as a fourth embodiment with reference to the timing chart of FIG. 13.

In the description below, a leftward-scrolling of images in which, in each display update cycle, display on the display changes in order of: FIG. 5A→FIG. 5B→FIG. 5C→FIG. 5D→FIG. 5E→FIG. 5F→FIG. 5G→FIG. 5H. When the length of the display update cycle is changed, the number of display subframes in one frame and scrolling speed (the time taken for an image to progress leftward by one dot) change. More specifically, in the exemplary case of FIG. 13, a section scrolling at display update cycle A is defined as the section of display update cycle A, and images of FIG. 5A to FIG. 5E are displayed in order of FIG. 5A→FIG. 5B→FIG. 5C→FIG. 5D→FIG. 5E in frames 1 to 5, respectively. On the other hand, a section scrolling at display update cycle B is defined as the section of display update cycle B, and images of FIG. 5F to FIG. 5H and FIG. 5A are displayed in order of FIG. 5F→FIG. 5G→FIG. 5H→FIG. 5A in frames 6 to 9, respectively.

For example, in the section of display update cycle A, when display update cycle A is 3 ms and the subframe cycle is 1 ms, the number of subframes in each frame is three. Thus, the image scrolls leftward by one dot every 3 ms. Further, in the section of display update cycle B, when display update cycle A is 5 ms and the subframe cycle is 1 ms, the number of subframes in each frame is five. Thus, the image scrolls leftward by one dot every 5 ms.

As shown above, in a moving image such as a scrolling image, the length of the display update cycle of changes, so that the number of subframes in one frame also changes. In such a case also, it is possible to display images in which subframe modulation is performed and expression of gradation is improved. Note that, details of subframe modulation is omitted in the description below.

Fifth Embodiment

In the third embodiment described above, an exemplary case of pulse width modulation is illustrated. However, as described above, in the present invention, the technique for realizing multi-gradation is not limited to pulse width modulation, but other technique can be used as appropriate in place of or in addition to pulse width modulation. As an exemplary case, the case of performing weighting control in place of pulse width modulation will be described as a fifth embodiment with reference to FIG. 14.

In the present embodiment, since pulse width modulation is just replaced by weighting control, for the sake of convenience, no description on timing chart or subframe modulation will be illustrated. Weighting control is such that, for example, in order to display gradation levels 0 to 15, setting the ratio of ON/OFF time of the sink-side switches SI1 to SI3 to be power of 2 such as 1:2:4:8 allows for displaying gradation levels from 0, in which none of LEDs are lit, to 15 (=1+2+4+8), in which all the LEDs are lit.

Figure 14:
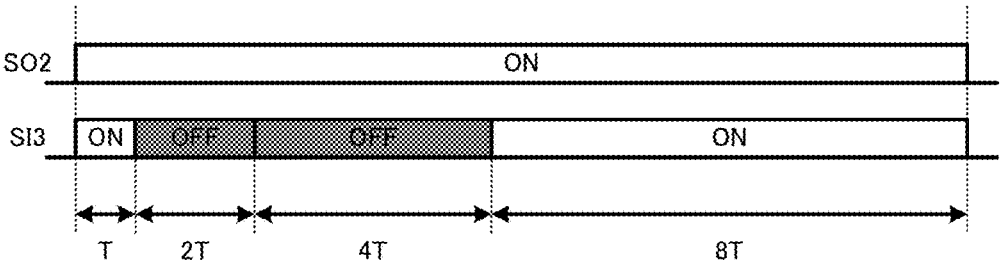
FIG. 14 is a schematic diagram showing weighting control according to a fifth embodiment.

In FIG. 14, by controlling the source-side switch SO2 and the sink-side switch SI3, the LED 6 is lit to express gradation level 9 (=9T/15T). Here, T being the ON/OFF time of SI3 is 1:2:4:8 (=T:2T:4T:8T).

In this manner, using weighting control for realizing gradations in a subframe also allows for displaying images with improved gradation expression.

Note that, while description in the first to fifth embodiments have been provided as the description of the display apparatus, it is not limited thereto, but the description can be used as methods of lighting a display apparatus.

As described above, in subframe modulation according to embodiments, displayed subframe numbers and subframe identification numbers are not matched among all the frames, and displayed subframe numbers and subframe identification numbers of successive frames are different from each other. That is, conventionally, one frame is divided into N-pieces of subframes, and all the N-pieces of subframes are displayed. As a result, in each frame, the subframe identification numbers given to 1st to Nth subframes in one frame and the display subframe numbers 1 to N expressing the appearing order of subframes correspond to each other.

On the other hand, in the present embodiment, M-pieces of virtual subframes, the number of which is greater than that of N-pieces of subframes described above, are generated. Also, the number of virtual subframes displayed in one frame is N, the displayed subframes do not correspond among the frames, and displayed subframes of successive frames are different from each other. As a result, the correspondence between the display subframe number and the virtual subframe identification number is different between successive frames.

Accordingly, in the present embodiment, since only a part of predetermined virtual subframes is displayed in each frame, gradation expression to be displayed cannot be realized if using just one frame. However, when a plurality of frame is observed as a series, images of the virtual subframes omitted in the preceding frame are displayed in the next frame. Thus, the subframes are complemented due to the visual afterimage effect. In this manner, without increasing the frame rate, the number of gradations levels that can be apparently expressed can be increased.

Example 1

Next, a display apparatus according to Example 1 is described below. The display apparatus according to Example 1 includes 1728 pieces of LEDs as the light emitting elements (LEDs include three types of light emitting elements of Red: R, Green: G, and Blue: B) arranged in the display at intervals of 4 mm vertically and horizontally. Further, 24 pieces of common lines connected to the anodes of the LEDs are arranged in the row direction, and 216 pieces (72 pieces×3 colors) of drive lines connected to the cathodes of the LEDs are arranged in the column direction.

Further, as the power supply circuit, a stabilized direct current voltage source of DC 5V is used. Further, an FPGA is used for the lighting control circuit 2 that time-divisionally applies voltage to the common lines. P-channel type FETs are used for the source drivers, and constant-current driven NPN transistors set to about 15 mA are used for the sink drivers.

The display apparatus according to Example 1 is dynamically driven at a duty ratio of 1/24. The time during which voltage is applied to one of the common lines is set to 47.9 μs, and the time during which voltage is applied to none of the common lines is set to 10 In this case, the subframe period becomes (47.9 μs+10 μS)×24 rows=1.39 ms.

64 gradation levels of each color from one image and 64 levels of dot correction are composed, and display of obtained 128 levels in total is supported by 4096 gradation control (per color) obtained by synthesizing 64 subframes and 64 levels of weighting control (6 bits). In this case, brightness per one gradation level is 1.6%. The display update cycle is 11 ms, and eight subframes are allocated for each frame (1.39 ms×8 subframes=11.1 ms).

Dot correction level is individually set for each of three types of LEDs of Red (R), Green (G), and Blue (B). Dot correction level is; for Red, 16 h on average; for green, 20 h on average; and for blue, 11 h on average.

In order to emerge the effect, the display is configured to arrange 1728 LEDs in a matrix of 24 rows×72 columns, and an image to be displayed is so modified that each column has different with eight gradation levels brightness. The image, which is arranged pixels in 24 rows and 8 columns with eight gradation levels, is repeatedly displayed while being scrolled leftward by one column every 11.1 ms.

More specifically, gradation levels in R, G, B of the image with eight gradation levels is the same. That is, gradation level of LEDs in the 1st column is 0; gradation level of LEDs in the 2nd column is 1 h; gradation level of LEDs in the 3rd column is 2 h; gradation level of the LEDs in the 4th column is 4 h; gradation level of the LEDs in the 5th column is 8 h; gradation level of the LEDs in the 6th column is 10 h; gradation level of the LEDs in the 7th column is 20 h; and gradation level of the LEDs in the 8th column is 40 h.

These gradation level of image and dot correction level are composed to perform subframe modulation similarly to the manner according to the third embodiment.

When such a display apparatus is visually observed, it is confirmed that the image with eight-level gradation in which gradation levels differs in each column is scrolled leftward. Accordingly, it can be evaluated that the display apparatus according to Example 1 can be evaluated to be a display apparatus with high gradation expressing performance.

Comparative Example 1

Next, a display apparatus according to Comparative Example 1 is illustrated. While the display apparatus according to Comparative Example 1 basically has the same structure as the display apparatus according to Example 1, 8 gradation levels of each color from an image and 64 levels by dot correction are composed to obtain display of 512 levels in total, and the obtained 512 levels is supported by 512 gradation control (per color) obtained by synthesizing eight subframes and 64 levels of weighting control (6 bits). More precisely, display of seven gradation level 7 is not performed, and out of nine levels, display is expressed by eight levels (0%, 12.5%, 25%, 37.5%, 50%, 62.5%, 75%, 100%).

The reason why the number of subframes is eight is that the display update cycle is 11 ms, with which one frame can include just eight subframes.

Since the image with the eight-step gradation originally have just eight gradations, gradation levels in R, G, B of the image with eight gradation levels is the same. That is, gradation level of LEDs in the 1st column is 0; gradation level of LEDs in the 2nd column is 1 h; gradation level of LEDs in the 3rd column is 2 h; gradation level of the LEDs in the 4th column is 3 h; gradation level of the LEDs in the 5th column is 4 h; gradation level of the LEDs in the 6th column is 5 h; gradation level of the LEDs in the 7th column is 6 h; and gradation level of the LEDs in the 8th column is 8 h When such a display apparatus is visually observed, it is confirmed that the image with eight-level gradation in which gradation levels differs in each column is scrolled leftward. However, while display of gradation level 1 which can be expressed by the display apparatus according to Example 1 has brightness 1.6%, the display of gradation level 1 expressed by the display apparatus according to the Comparative Example 1 is 12.5%, which is the same brightness expressed by gradation 8 h of the display apparatus according to Example 1.

Accordingly, since the display apparatus according to Comparative Example 1 is capable of expressing gradations only in the number corresponding to the number of subframes in one frame, the display apparatus according to Comparative Example 1 can be evaluated as a display apparatus with inferior color expressing performance.

With the display apparatus according to embodiment of the present invention described above, while only some of predetermined virtual subframes is displayed in each actual frame and therefore the gradation expression to be displayed cannot be achieved, when a plurality of frames are observed through, the virtual subframes which is not shown in one frame are complemented due to the virtual afterimage effect. Accordingly, gradation levels that can be apparently expressed can be increased.

In the description above, the embodiments and/or Example of the present invention have been described with reference to the drawings. However, the embodiments, Example, variations and the like are merely examples for embodying the technical idea of the present invention, and the present invention is not limited thereto. Further, the present specification is not intended to limit the members shown in the claims to the members in the embodiments. In particular, the dimension, material, shape, and relative disposition of the constituent elements described in the embodiments are not intended to limit the scope of the present invention only thereto, and are provided merely as examples. Note that, the size or positional relationship of members shown in the drawings may be exaggerated for the sake of clarity. Further, in the description above, identical names and reference characters refer to the identical or similar members, and detailed descriptions are omitted as appropriate. Further, the elements structuring the present invention may be in a manner in which a plurality of elements are structured by an identical members such that one member has the function of the plurality of elements. Conversely, a plurality of members may share the function of one member.

INDUSTRIAL APPLICABILITY

The display apparatus, the lighting control circuit, and the method of driving lighting of the display apparatus of the present disclosure can be used for a large-size television set, traffic information and the like.

What is claimed is:

1. A display apparatus comprising:

a plurality of light emitting elements arranged in rows and columns to form a display, each of the plurality of light emitting elements having a first terminal and a second terminal, the first terminal being connected to one of a plurality of common lines arrange in rows and the second terminal being connected to one of a plurality of driving lines arrange in columns;

a voltage controller connected to common lines to apply voltage thereto;

a current driver connected to the drive lines to flow current therethrough in accordance with timing at which the voltage controller applies voltage; and a lighting control circuit connected to the voltage controller and the current driver so as to control lighting of the light emitting elements based on a supplied display data including images to be displayed on the display, each image comprising a plurality of frames, each frame being divided into N-pieces of actual subframes which are defined based on hardware specification, and each frame being also divided into M-pieces of virtual subframes, respectively, wherein N is a natural number equal to or greater than two, and M is a natural number greater than N, wherein a frame rate f is predetermined to perform display at a subframe cycle of 1/(f×N), wherein the lighting control circuit controls the voltage controller and the current driver by dividing a first frame into M-pieces of the virtual subframes based on the display data, and partially selecting N-pieces out of the M-pieces of the virtual subframes to be displayed in the first frame so that a displaying of the selected N-pieces out of the M-pieces of the virtual subframes is performed in the first frame which duration is 1/f at the predetermined frame rate f, the N of the N-pieces of the selected virtual subframes being the same number with the N of the N-pieces of the displayed virtual subframes, while the lighting control circuit discards (M−N) pieces of the virtual subframes as undisplayed virtual subframes in the first frame, and wherein in a second frame subsequent to the first frame, the lighting control circuit controls the voltage controller and the current driver by dividing the second frame into M-pieces of the virtual subframes, and preferentially selecting the virtual subframes corresponding to the undisplayed virtual subframes in the first frame out of the M-pieces of the virtual subframes as second displayed actual subframes, the M of the M-pieces of the virtual subframes in the second frame being the same number with the M of M-pieces of the virtual subframes in the first frame.

2. The display apparatus according to claim 1, wherein the lighting control circuit divides the first and second frames into the M-pieces of the virtual subframes assigning gradation levels by gradation conversion on the virtual subframes so as to display an image of a frame having expected gradation levels with the M-pieces of the virtual subframes.

3. The display apparatus according to claim 2, wherein the lighting control circuit performs the gradation conversion on the virtual subframes with reallocation of the virtual subframes in which the light emitting elements is ON such that ON virtual subframes are uniformly arranged.

4. The display apparatus according to claim 1, wherein the lighting control circuit performs pulse width modulation or weighting control on the M-pieces of the virtual subframes.

5. The display apparatus according to claim 1, wherein M is a power of 2.

6. The display apparatus according to claim 1, wherein M≤2N.

7. The display apparatus according to claim 1, wherein the lighting control circuit assigns a unique identification information to each of the M-pieces of the virtual subframes, and wherein the identification information of a plurality of displayed subframes in any one frame is at least partially different from one of a plurality of displayed subframes in an other frame successive to the any one frame.

8. The display apparatus according to claim 7, wherein the virtual subframes of every identification information are displayed at displayed subframes in the any one frame and the displayed subframes in the other frame successive to the one frame.

9. The display apparatus according to claim 7, wherein the identification information is information identifying which virtual subframe is to be performed with increasing gradation level to display an image with multi-gradation by subframe modulation.

10. The display apparatus according to claim 7, wherein the virtual subframe identification information appears in numerical order either within one frame, or in a frame that is successive to the one frame.

11. The display apparatus according to claim 7, wherein a frame cycle through which virtual subframe identification numbers appear is 30 Hz or smaller, and a subframe cycle through which each of subframes is displayed is 120 Hz or greater.

12. The display apparatus according to claim 1, wherein the lighting control circuit sends gradation data of an image to the display.

13. The display apparatus according to claim 1, wherein the lighting control circuit sends correction data for correcting brightness variations among brightness of the light emitting elements to the display in addition to the gradation data of the image.

14. The display apparatus according to claim 1, wherein the lighting control circuit controls a display update cycle which is a cycle of updating display of one frame to be different from a display update cycle of another frame.

15. The display apparatus according to claim 1, wherein the plurality of light emitting elements in the display are arranged in a matrix shape.

16. The display apparatus according to claim 15, wherein the image displayed on the display is a still image or a moving images, in the moving images a displayed content scrolls.

17. A method of lighting a display apparatus, the apparatus comprising:

a plurality of light emitting elements arranged in rows and columns to form a display, each of the plurality of light emitting elements having a first terminal and a second terminal, the first terminal being connected to one of a plurality of common lines arrange in rows and the second terminal being connected to one of a plurality of driving lines arrange in columns;

a voltage controller connected to common lines to apply voltage thereto;

a current driver connected to the drive lines to flow current therethrough in accordance with timing at which the voltage controller applies voltage; and a lighting control circuit connected to the voltage controller and the current driver so as to control lighting of the light emitting elements based on a supplied display data including images to be displayed on the display, each image comprising a plurality of frames, each frame being divided into N-pieces of actual subframes which are defined based on hardware specification, and each frame being also divided into M-pieces of virtual subframes, respectively, wherein N is a natural number equal to or greater than two, and M is a natural number greater than N, wherein a frame rate f is predetermined to perform display at a subframe cycle of 1/(f×N), the method comprising:

acquiring the display data to be displayed on the display;

dividing a first frame into M-pieces of successive virtual subframes for each of the plurality of light emitting elements based on the display data, to display the M-pieces of the successive virtual subframes at the subframe cycle of 1/(f×N) at the predetermined frame rate f to display the image of the first frame on the display;

partially selecting N-pieces out of the M-pieces of the virtual subframes and displaying the selected N-pieces out of the M-pieces of the virtual subframes in the first frame while discarding (M−N) pieces of the virtual subframes as undisplayed virtual subframes in the first frame;

dividing a second frame into M-pieces of the virtual subframes; and preferentially selecting the virtual subframes corresponding to the undisplayed virtual subframes in the first frame out of the M-pieces of the virtual subframes as second displayed subframes.

18. The method of lighting a display apparatus according to claim 17, wherein, when the one frame is divided into the M-pieces of the successive virtual subframes, the number of gradation levels of the virtual subframe is different from the number of the gradation levels of the first frame, and gradation conversion is performed with the successive virtual subframes so that the image of a frame having desired gradation levels is displayed when the M-pieces of the successive virtual subframes are added up.

19. The method of lighting a display apparatus according to claim 17, wherein, when the gradation conversion with the successive virtual subframes is performed, a display order of the successive virtual subframes may be set such that the successive virtual subframes of different gradation levels are dispersed in the M-pieces of the successive virtual subframes.

20. The method of lighting a display apparatus according to 17, wherein a pulse width modulation or a weighting control is performed on the M-pieces of the successive virtual subframes in one frame.

21. The method of lighting a display apparatus according to claim 17, wherein M is a number of a power of 2.

22. A display apparatus comprising:

a plurality of light emitting elements arranged in rows and columns to form a display, each of the plurality of light emitting elements having a first terminal and a second terminal, the first terminal being connected to one of a plurality of common lines arrange in rows and the second terminal being connected to one of a plurality of driving lines arrange in columns, a voltage controller connected to common lines to apply voltage thereto;

a current driver connected to the drive lines to flow current therethrough in accordance with timing at which the voltage controller applies voltage; and a lighting control circuit connected to the voltage controller and the current driver so as to control lighting of the light emitting elements based on a supplied display data including images to be displayed on the display, each image comprising a plurality of frames, each frame being divided into N-pieces of actual subframes which are defined based on hardware specification, and each frame being also divided into M-pieces of virtual subframes, respectively, wherein N is a natural number equal to or greater than two, and M is a natural number greater than N, wherein a frame rate f is predetermined to perform display at a subframe cycle of $1/(f \times N)$, wherein the lighting control circuit controls the voltage controller and the current driver by dividing a first frame into M-pieces of the virtual subframes based on the display data, and partially selecting N-pieces out of the M-pieces of the virtual subframes to be displayed in the first frame so that a displaying of the selected N-pieces out of the M-pieces of the virtual subframes is performed in the first frame which duration is 1/f at the predetermined frame rate f, while the lighting control circuit discards (M−N) pieces of the virtual subframes as undisplayed virtual subframes in the first frame, and wherein in a second frame subsequent to the first frame, the lighting control circuit controls the voltage controller and the current driver by dividing the second frame into M-pieces of the virtual subframes, and preferentially selecting the virtual subframes corresponding to the undisplayed virtual subframes in the first frame out of the M-pieces of the virtual subframes as second displayed subframes.

* * * * *